US007395003B2

(12) United States Patent
Dan

(10) Patent No.: US 7,395,003 B2
(45) Date of Patent: Jul. 1, 2008

(54) FUSER TEMPERATURE CONTROL PROVIDING FASTER WAKE UP FROM COLD START BY OPTIMIZING STANDBY TEMPERATURE OF FUSER ROLLER

(75) Inventor: Kenichi Dan, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 191 days.

(21) Appl. No.: 11/065,459

(22) Filed: Feb. 25, 2005

(65) Prior Publication Data

US 2005/0191076 A1 Sep. 1, 2005

(30) Foreign Application Priority Data

Mar. 1, 2004 (JP) ..... 2004-056491

(51) Int. Cl.
*G03G 15/20* (2006.01)

(52) U.S. Cl. ..... 399/70

(58) Field of Classification Search ..... 399/70, 399/69

See application file for complete search history.

(56) References Cited

U.S. PATENT DOCUMENTS

| | | | | |
|---|---|---|---|---|
| 5,321,479 | A * | 6/1994 | Yoshida et al. | 399/70 |
| 6,185,388 | B1 * | 2/2001 | Yamamoto | 399/69 |
| 6,816,686 | B2 * | 11/2004 | Hooper et al. | 399/44 |
| 2001/0013943 | A1 * | 8/2001 | Hashimoto et al. | 358/1.13 |

FOREIGN PATENT DOCUMENTS

| | | |
|---|---|---|
| JP | A-05-127565 | 5/1993 |
| JP | B2-3119690 | 12/2000 |

* cited by examiner

*Primary Examiner*—Quana M Grainger
(74) *Attorney, Agent, or Firm*—Oliff & Berridge, PLC

(57) ABSTRACT

An apparatus is disclosed which is for forming an image using a fuser unit, including: a fuser roller; a heater heating the fuser roller; a temperature sensor detecting a temperature of the fuser roller; and a controller controlling the heater to substantially achieve a desired temperature of the fuser roller, wherein the controller includes a desired-temperature setting device. The device is operated during a cold start of the fuser unit, so as to set the desired temperature to a second standby-temperature which is lower than a fusing temperature and higher than a normal standby-temperature, so as to maintain the desired temperature at the second standby-temperature during a heat-storing period during which heat is stored in the fuser unit, and so as to set the desired temperature to the normal standby-temperature upon termination of the heat-storing period.

19 Claims, 16 Drawing Sheets

FUSER TEMPERATURE CONTROL PROVIDING FASTER WAKE UP FROM COLD START BY OPTIMIZING STANDBY TEMPERATURE OF FUSER ROLLER

This application is based on Japanese Patent Application No. 2004-056491 filed Mar. 1, 2004, the content of which is incorporated hereinto by reference.

CROSS-REFERENCE TO RELATED APPLICATIONS

Not Applicable.

BACKGROUND OF THE INVENTION

1. Field of the Invention

The present invention relates to a technique employed in an image forming apparatus such as a laser printer, and more particularly to a technique of controlling the temperature of a fuser roller fusing an image to a receiver medium such as a print sheet.

2. Description of the Related Art

Typically, an image forming apparatus such as a laser printer is operated in combination with a fuser unit. The fuser unit is provided for heating a print sheet bearing an unfused toner thereon and then fusing the toner image to the print sheet.

The above fusing unit is typically configured to include: a fuser roller incorporating a heater therein; a pressure roller disposed in pressure contact with the fuser roller; a temperature sensor (e.g., a thermistor) detecting the surface temperature of the fuser roller; etc. In printing operation, the fuser unit controls the heater in an on-off manner based on a signal from the temperature sensor, to thereby perform a fusing operation such that the surface temperature of the fuser roller is maintained at a predetermined level.

In operation, such an image forming apparatus performs a warm-up operation once a printing operation becomes required soon after the occurrence of a cold start of the fuser unit. The term "cold start" may be defined to mean a start immediately from a power-on event of the image forming apparatus, a start immediately from the release of an operation mode of the image forming apparatus from a sleep mode, etc.

Conventionally, even when the temperature of the surface of the fuser roller reaches a desired fusing-temperature owing to the above warm-up operation, the remaining portion of the image forming apparatus (possibly including the remaining portion of the fuser roller and the remaining portion of the fuser unit) fails to become adequately warm. For the reason, once the printing operation begins, the heating process of the fuser roller runs short due to heat scattering and lost into the above remaining portion and the print sheet, possibly resulting in an inadequate fixing of the print sheet.

For avoiding the inadequate fixing, it is conventional to take an approach to inhibit a printing operation during a given length of period elapsed from the occurrence of the power-on event of the image forming apparatus, or an approach to temporally maintain the temperature of the fuser roller at a temperature higher than the desired fusing temperature, i.e., a desired operating temperature. The latter approach is disclosed in Japanese Patent No. 3,119,690.

BRIEF SUMMARY OF THE INVENTION

The inventor's research on the above two approaches has revealed that, the former approach suffers from a drawback that the user of the image forming apparatus is forced to wait for a prolonged time until a printing operation starts, and the latter approach suffers from a drawback that the fuser roller is possibly overheated due to application of too much heat to the print sheet, possibly resulting in re-attachment of a toner from the print sheet to the fuser roller.

It is therefore an object of the present invention to provide a technique of controlling the temperature of the fuser roller that allows reduction in length of time during which the user is required to wait until a printing operation starts during a cold start, and/or that allows avoidance of overheating of the print sheet.

According to the present invention, there is provided an apparatus for forming an image using a fuser unit that heats a receiver medium bearing an unfused toner image thereon, during a relative movement of the receiving medium to the fuser unit, to thereby fuse the unfused toner image onto the receiver medium, the fuser unit comprising:

a fuser roller;

a heater heating the fuser roller;

a temperature sensor detecting a temperature of the fuser roller; and a controller controlling the heater for an actual temperature of the fuser roller to substantially achieve a desired temperature thereof, based on the temperature of the fuser roller detected by the temperature-sensor, the controller including a desired-temperature setting device that selects one of a plurality of optional temperatures including; a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the desired-temperature setting device being operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period.

As is evident from the above description, the above apparatus is configured, such that the heat-storing period for applying heat to the fuser roller for heat storage is provided. Further, the above apparatus is operated, such that the temperature of the fuser roller is maintained during the heat-storing period in the event of the cold start, at the second standby-temperature higher than the normal standby-temperature. As-a result, the whole fuser unit is warmed up quicker than when the temperature of the fuser roller is maintained at the normal standby-temperature.

The above apparatus is operated, such that the fuser unit is adequately warmed up with the temperature being at the second standby-temperature, with the result that deficiency in temperature of the fuser roller is not caused where the temperature of the fuser roller is raised up to the desired fusing temperature in response to issue of a print request from the user.

The above apparatus is configured, such that the second standby-temperature is set so as to be lower than the fusing temperature established for a fusing operation of the fuser unit, resulting in avoidance of re-attachment of a toner from the receiver medium to the fuser roller due to overheating of the receiver medium.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities show. In the drawings.

DETAILED DESCRIPTION OF THE INVENTION

Figure 1:
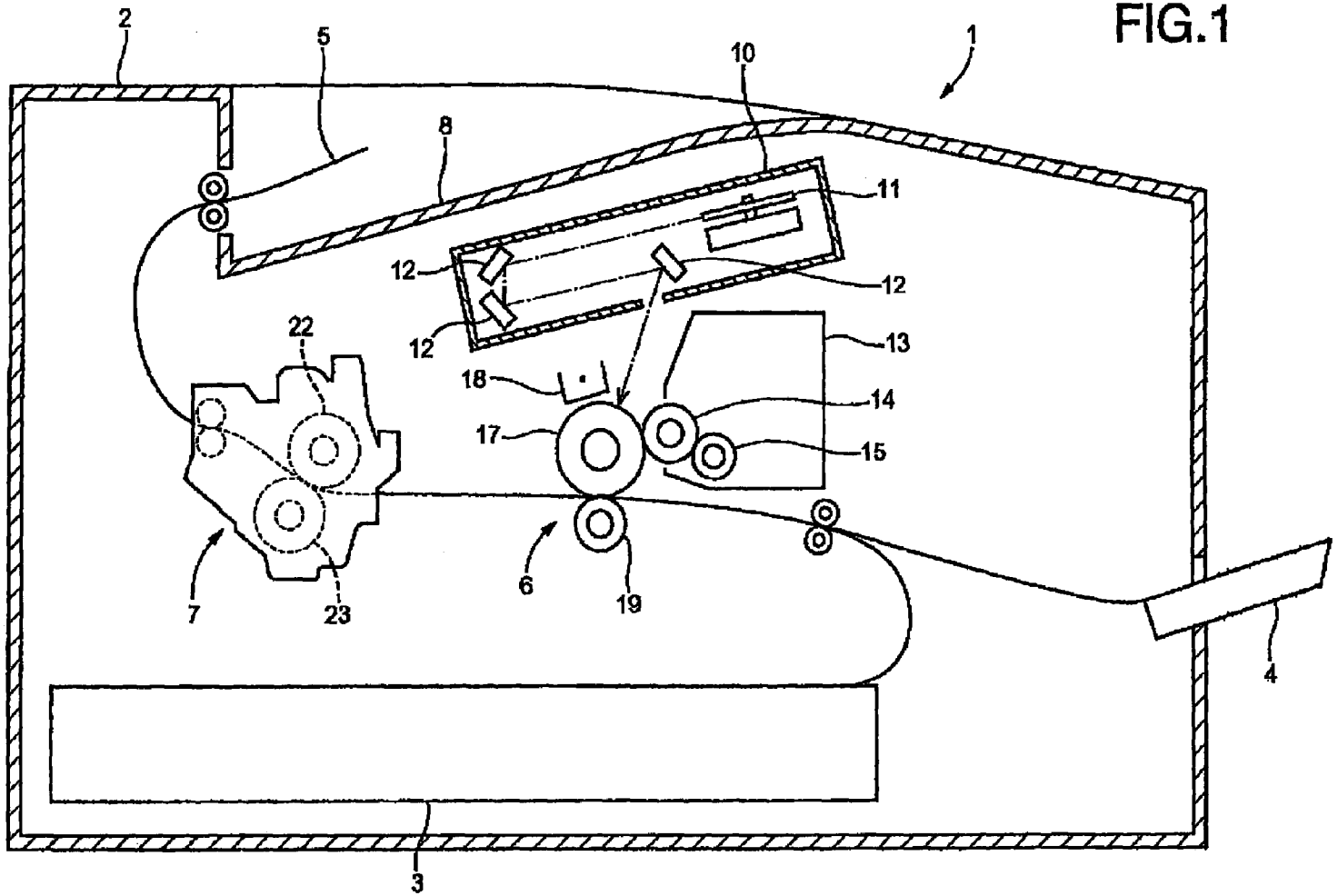
FIG. 1 is a sectional view illustrating a laser printer according to a first embodiment of the present invention.

The object mentioned above may be achieved according to any one of the following modes of this invention.

These modes will be stated below such that these modes are sectioned and numbered, and such that these modes depend upon the other mode or modes, where appropriate. This is for a better understanding of some of a plurality of technological features and a plurality of combinations thereof disclosed in this description, and does not mean that the scope of these features and combinations is interpreted to be limited to the scope of the following modes of this invention.

That is to say, it should be interpreted that it is allowable to select the technological features which are stated in this description but which are not stated in the following modes, as the technological features of this invention.

Furthermore, stating each one of the selected modes of the invention in such a dependent form as to depend from the other mode or modes does not exclude a possibility of the technological features in a dependent-form mode to become independent of those in the corresponding depended mode or modes and to be removed therefrom. It should be interpreted that the technological features in a dependent-form mode is allowed to become independent according to the nature of the corresponding technological features, where appropriate.

(1) An apparatus for forming an image using a fuser unit that heats a receiver medium bearing an unfused toner image thereon, during a relative movement of the receiving medium to the fuser unit, to thereby fuse the unfused toner image onto the receiver medium, the fuser unit comprising:

a fuser roller;

a heater heating the fuser roller;

a temperature sensor detecting a temperature of the fuser roller; and a controller controlling the heater for an actual temperature of the fuser roller to substantially achieve a desired temperature thereof, based on the temperature of the fuser roller detected by the temperature sensor, the controller including a desired-temperature setting device that selects one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the desired-temperature setting device being operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period.

As is readily understood from the above, the apparatus according to the above mode (1) is configured, such that the heat-storing period for applying heat to the fuser roller for heat storage is provided. Further, the apparatus is operated, such that the temperature of the fuser roller is maintained during the heat-storing period in the event of the cold start, at the second standby-temperature higher than the normal standby-temperature. As a result, the whole fuser unit is warmed up quicker than when the temperature of the fuser roller is maintained at the normal standby-temperature.

The apparatus according to the above mode (1) is operated, such that the fuser unit is adequately warmed up with the temperature being at the second standby-temperature, with the result that deficiency in temperature of the fuser roller is not caused where the temperature of the fuser roller is raised up to the desired fusing temperature in response to issue of a print request from the user.

The apparatus according to the above mode (1) allows a quick rise in temperature of the fuser roller from the second standby-temperature which is higher than the normal standby-temperature to the desired fusing temperature. This avoids the length of time during which the user has to wait until a printing operation starts from becoming longer than when the apparatus is operated such that a printing operation is inhibited for a given length of time after issue of a print request from the user.

The apparatus according to the above mode (1) is configured, such that the second standby-temperature is set so as to be lower than the fusing temperature established for a fusing operation of the fuser unit, resulting in avoidance of re-attachment of a toner from the receiver medium to the fuser roller due to overheating of the receiver medium.

The apparatus according to the above mode (1) may be operated such that the temperature of the fuser roller is raised as low as the second standby-temperature lower than the fusing temperature, where a printing operation does not start immediately after the initiation of a cold start of the fuser unit. This allows the power consumption of the fuser unit to become less than when the temperature of the fuser roller never fail to be temporally raised to a temperature higher than the fusing temperature.

(2) The apparatus according to mode (1), wherein the desired-temperature setting device comprises a first setting device setting the desired temperature in at least one of a first manner allowing the desired temperature to be initially set to the second standby-temperature during the cold start, and a second manner allowing the desired temperature to be set to any one of the plurality of optional temperatures excluding the second standby-temperature, prior to a setting of the desired temperature to the second standby-temperature.

(3) The apparatus according to mode (1) or (2), wherein the desired-temperature setting device comprises a limit setting device establishing an upper limit and a lower limit for each of the second standby-temperature and the normal standby-temperature, and wherein the controller is operated so as to deactivate the heater upon rise of the actual temperature of the fuser roller to the established upper limit, and so as to activate the heater upon drop of the actual temperature of the fuser roller to the established lower limit, and wherein the limit setting device establishes the upper and the lower limit, such that a difference therebetween is smaller for the second standby-temperature during the heat-storing period than for the normal standby-temperature.

The apparatus according to the above mode (3) is configured, such that the operating state of the heater is controlled depending on the relationship in magnitude between the upper and lower limits of the respective desired standby-temperatures and the temperature of the fuser roller detected by the temperature sensor.

In the apparatus, the difference between the upper and lower limits corresponds to the width of a dead band or an allowable range over which the actual state of the heater is allowed not to respond to any variations in actual temperature of the fuser roller.

Too small width of the dead band would cause frequent shifts between an off and an on state of the heater, eventually leading to frequent flickers of room lights connected to the same power line.

In view of the above, the apparatus according to the above mode (3) is configured, such that the difference between the upper and lower limits, i.e., the width of the dead band for each of the normal and second standby-temperatures is set to be suitably large, to thereby eliminate flickers of the room lights.

On the other hand, too large width of the dead band would readily bring about variations in temperature of the fuser roller occurring immediately after the start of a fusing operation of the fuser unit, as it is especially true where the fusing operation starts with a previous heat-storage in the fuser unit being inadequate. This possibly results in an event of overheating due to excessive heat or otherwise an inadequate fixing due to deficiency of heat.

In view of the above, the apparatus according to the above mode (3) is configured, such that the difference between the upper and lower limits, i.e., the width of the dead band for the second standby-temperature is set to be smaller than that of the normal standby-temperature, to thereby eliminate variations in temperature occurring immediately after the start of the fusing operation even where the fusing operation starts with the heat storage in the fuser unit being inadequate, with the result of elimination of inadequate fixing.

In the apparatus according to the above mode (3), the possibility that the room lights frequently flicker due to changes in on-off state of the heater can be eliminated as a result of the setting of the length of the period during the temperature of the fuser roller is maintained at the second standby-temperature so as to be shorter than that of the period during which the temperature of the fuser roller is maintained at the normal standby-temperature.

(4) The apparatus according to mode (3), wherein the heat-storing period is shorter than a period during which the temperature of the fuser roller is maintained at the normal standby-temperature.

The apparatus according to the above mode (4) reduces how many times the on-off state of the heater is varied during the heat-storing period, resulting in an eliminated possibility that the aforementioned room lights frequently flicker due to changes in on-off state of the heater.

(5) The apparatus according to any one of modes (1) through (4), wherein the controller comprises a first period determining device determining a length of the heat-storing period based on at least one of a length of an elapsed time during which the temperature of the fuser roller rises from a temperature thereof at the cold start to a reference temperature, and a gradient of the temperature of the fuser roller, using the temperature of the fuser roller detected by the temperature sensor.

The apparatus according to the above mode (5) is configured, such that the desired length of the heat-storing period is determined based on at least one of the length of the elapsed time between the temperature of the fuser roller being at an actual temperature (e.g., an initial temperature) during the cold start and being at a reference temperature, and a gradient of the temperature of the fuser roller.

The apparatus according to the above mode (5) therefore allows the desired length of the heat-storing period to be determined so as not to be unnecessarily long, resulting in reduction in power consumption of the fuser unit, when practiced.

(6) The apparatus according to mode (5), wherein the first period determining device determines the length of the heat-storing period such that the longer the length of the elapsed time becomes, the longer the determined length of the heat-storing period becomes.

(7) The apparatus according to mode (5) or (6), wherein the reference temperature substantially coincides in level with the normal standby-temperature.

(8) The apparatus according to any one of modes (5) through (7), further comprising a first cold-start determining device determining an event of the cold start.

(9) The apparatus according to any one of modes (1) through (8), wherein the controller comprises a second period determining device determining a length of the heat-storing period based on the temperature of the fuser roller detected by the temperature sensor at the cold start.

The apparatus according to the above mode (9), because of the above construction, allows the desired length of the heat-storing period to be determined so as not to be unnecessarily long, resulting in reduction in power consumption of the fuser unit, when practiced.

(10) The apparatus according to mode (9), wherein the second period determining device determines the length of the heat-storing period such that the lower the temperature of the fuser roller detected by the temperature sensor becomes, the longer the determined length of the heat-storing period becomes.

(11) The apparatus according to mode (9) or (10), further comprising a second cold-start determining device determining whether or not an event of the cold start occurs.

(12) The apparatus according to-any one of modes (1) through (11), wherein the desired-temperature setting device comprises a second setting device setting the desired temperature to the normal standby-temperature, upon termination of a fusing operation by the fuser unit during the heat-storing period.

Where a fusing operation of the fuser unit is performed and then terminated in the course of the heat-storing period, it may be reasonable to consider that the fuser unit has been adequately warmed up because of the fusing operation even before the termination of the heat-storing period.

In view of the above findings, the apparatus according to the above mode (12) is configured, such that the desired temperature of the fuser roller is set to the normal standby-temperature, not to the second standby-temperature which is higher than the normal standby-temperature, upon termination of the fusing operation by the fuser during the heat-storing period. The apparatus therefore facilitates reduction in power consumption of the fuser unit, when practiced.

(13) The apparatus according to mode (12), further comprising a fusing-operation determining device determining whether or not a termination of the fusing operation occurs.

(14) The apparatus according to any one of modes (1) through (13), wherein the desired-temperature setting device comprises a third setting device selecting one of the second standby-temperature and the normal standby-temperature and setting the desired temperature to the selected one, based on a length of a period during which the temperature of the fuser roller was maintained at the second standby-temperature, upon termination of a fusing operation by the fuser unit during the heat-storing period.

Where a fusing operation of the fuser unit is performed and then terminated in the course of the heat-storing period, whether or not the fuser unit has been adequately warmed up because of the fusing operation may depend on the length of the duration time during which the temperature of the fuser roller was maintained at the second standby-temperature during the heat-storing period. The findings show that the known length of the duration time determines whether or not the fuser unit has been adequately warmed up.

In view of the above, the apparatus according to the above mode (14) is configured, such that the desired temperature is determined as one of the second standby-temperature and the normal standby-temperature, which is selected based on the length of a period during which the temperature of the fuser roller was maintained at the second standby-temperature, upon termination of the fusing operation during the heat-storing-period.

According to an arrangement of the above mode (14), the desired temperature of the fuser roller is set to the normal standby-temperature, not the second standby-temperature, where the length of the period during which the temperature of the fuser roller was maintained at the second standby-temperature is adequately long, while the desired temperature is set to the second standby-temperature, to thereby continue the heat storage of the fuser unit, where the above length is not adequately long.

The above arrangement allows reduction in power consumption of the fuser unit, while avoiding inadequate fixing due to deficiency in length of the heat storage of the fuser unit.

(15) The apparatus according to any one of modes (1) through (14), wherein the desired-temperature setting device comprises a fourth setting device selecting one of the second standby-temperature and the normal standby-temperature and setting the desired temperature to the selected one, based on a length of a period during the temperature of the fuser roller was maintained at the fusing temperature, upon termination of a fusing operation by the fuser unit during the heat-storing period.

Where a fusing operation of the fuser unit is performed and then terminated in the course of the heat-storing period, whether or not the fuser unit has been adequately warmed up because of the fusing operation may depend on the length of the duration time during which the temperature of the fuser roller was maintained at the fusing temperature. The findings show that the known length of the duration time determines whether or not the fuser unit has been adequately warmed up.

In view of the above, the apparatus according to the above mode (15) is configured, such that the desired temperature is determined as one of the second standby-temperature and the normal standby-temperature, which is selected based on the length of a period during which the temperature of the fuser roller was maintained at the fusing temperature, upon termination of the fusing operation during the heat-storing period.

(16) The apparatus according to mode (15), further comprising a measuring device measuring a length of a period during which the temperature of the fuser roller was maintained at the fusing temperature, based on an amount of the receiver medium processed during a continuous implementation of the fusing operation.

The amount of the receiver medium processed during a continuous implementation of the fusing operation reflects the length of a period during which the temperature of the fuser roller was maintained at the fusing temperature. In view of the findings, the apparatus according to the above mode (16) is constructed as described above.

The "receiver medium processed" means the "receiver medium fused." The "amount of the receiver medium" may be interpreted to mean, where the receiver medium is in the form of successive and separate print sheets, the page count of the print sheets that were fused during the newest cycle of implementation of the fusing operation.

(17) The apparatus according to any one of modes (1) through (16), wherein the desired-temperature setting device comprises a fifth setting device selecting one of the second standby-temperature and the normal standby-temperature and setting the desired temperature to the selected one, based on a kind of the receiver medium for which a fusing operation was implemented by the fuser unit; upon termination of the fusing operation during the heat-storing period.

Where a fusing operation of the fuser unit is performed and then terminated in the course of the heat-storing period, whether or not the fuser unit has been adequately warmed up because of the fusing operation may depend on the kind of the receiver medium fused during the fusing operation.

A typical example of the kind of the receiver medium may be the thermal properties thereof, and a typical example of the thermal properties, when the receiver medium is in the form of a print sheet, may be the thickness of the print sheet. The findings show that the known kind of the receiver medium determines whether or not the fuser unit has been adequately warmed up.

In view of the above, the apparatus according to the above mode (17) is configured, such that the desired temperature is determined as one of the second standby-temperature and the normal standby-temperature, which is selected based on the kind of the receiver medium for which a fusing operation was implemented by the fuser unit, upon termination of the fusing operation during the heat-storing period.

According to an arrangement of the above mode (17), the desired temperature of the fuser roller is set to the normal standby-temperature, where a thicker print sheet having a larger heat capacity was fused during the fusing operation, meaning that the heat storage in the fuser unit was adequately performed, while the desired temperature is set to the second standby-temperature, to thereby continue the heat storage of the fuser unit, where a normal print sheet having a normal thickness and heat capacity was fused during the fusing operation, meaning that the heat storage in the fuser unit was not adequately performed.

The above arrangement allows reduction in power consumption of the fuser unit, when practiced.

(18) The apparatus according to any one of modes (1) through (17), wherein the heater is in the form of a halogen heater disposed within the fuser roller.

The apparatus according to the above mode (18), because of the heater unit employing the halogen heater, is more advantageous in reduction of cost of manufacture than when the heater unit is constructed such that a resistive heating element is disposed in the vicinity of the surface of the fuser roller, for example.

(19) The apparatus according to any one of modes (1) through (18), wherein the controller comprises an allowable-range setting device setting an allowable range for the second standby-temperature, such that a width of the allowable range is varied with time during the heat-storing period.

In the apparatus according to the above mode (19), the allowable range corresponds to the aforementioned dead-band for the control of the heater. On the other hand, the smaller the width of the dead band, the higher the accuracy of the controlled temperature of the fuser roller at the beginning of the coming fusing operation. The larger the width of the dead band, the lower the frequency of the flickers of the room lights.

In view of the above findings, the apparatus according to the above mode (19) is operated, such that the width of the allowable range is varied with time during the heat-storing period.

(20) The apparatus according to mode (19), wherein the allowable-range setting device sets the allowable range such that the width of the allowable range becomes larger during a later part of the heat-storing period than during an early part of the same heat-storing period.

The apparatus according to the above mode (20) is operated, such that the actual state of the heater under control is more sensitive to the actual temperature of the fuser roller during the early part of the heat-storing period, than during the later part of the same heat-storing period.

Therefore, the actual temperature of the fuser roller tends to be controlled more accurately during the early part than during the later part, while the actual temperature of the fuser roller tends to be varied less frequently during the later part than during the early part.

(21) A fuser unit comprising:

a fuser roller;

a heater heating the fuser roller; and a temperature sensor detecting a temperature of the fuser roller, wherein the heater is controlled based on the temperature of the fuser roller detected by the temperature sensor during a cold start of the fuser unit, such that the temperature of the fuser roller substantially coincides with a second standby-temperature which is lower than an operating temperature of the fuser roller to be achieved during a fusing operation by the fuser unit and higher than a normal standby-temperature, during a heat-storing period during which heat is applied to and stored in the fuser unit, and such that the temperature of the fuser roller drops to the normal standby-temperature upon termination of the heat-storing period.

The fuser unit according to the above mode (21) allows for a faster wake up from a cold start of the fuser roller, and for a reduced re-attachment of a toner from a receiver medium to the fuser roller due to overheating of the receiver medium, according to basically the same principle as that employed in the fuser roller in the apparatus according to any one of the above mode (1) through (20).

Several presently preferred embodiments of the invention will be described in more detail by reference to the drawings in which like numerals are used to indicate like elements throughout.

FIG. 1 shows schematically in sectional view a laser printer 1 as an image forming apparatus in accordance with a first embodiment of the present invention.

The laser printer 1 has a body casing 2, and a first tray 3 and a second tray 4 which are disposed in the lower portion of the body casing 2. In the laser printer 1, an image forming unit 6 forms a toner image on a print sheet 5 which is an example of a receiver medium supplied from a selected one of the first tray 3 and the second tray 4. By a fuser unit 7, a fusing operation is then performed to fuse the toner image with heat, and the print sheet 5 is finally delivered to an exit tray 8 disposed at the top of the body casing 2.

The image forming unit 6 is constructed so as to include: a scanning unit 10; a process cartridge 13; a photoconductive drum 17; a charger 18; a transfer roller 19, etc.

The scanning unit 10, which is disposed at the top of the body casing 2, includes: a laser light emitter not shown; a polygon mirror 11; a plurality of reflective mirrors 12; a plurality of lenses not shown; etc. The scanning unit 10 illuminates the surface of the photoconductive drum 17 with laser light which is emitted from the laser light emitter, via the polygon mirror 11, the reflective mirrors 12, and the lenses, to the photoconductive drum 17, as shown by a dashed line in FIG. 1, to thereby scan the photoconductive drum 17 at a higher speed.

The process cartridge 13, which is removably mounted to the body casing 2, stores a toner made up of positively-charged non-magnetic component or material. At a toner delivery opening formed in the process cartridge 13, a developer roller 14 and a supply roller 15 are disposed in opposed relation with each other, and the developer roller 14 is arranged in opposed relation with the photoconductive drum 17. A development bias is applied to the developer roller 14 for development. The toner in the process cartridge 13 is supplied to the developer roller 14 because of the rotation of the supply roller 15, so that the toner is frictionally electrified positively between the developer roller 14 and the supply roller 15, whereby the toner becomes borne on the developer roller 14.

The photoconductive drum 17 is electrically grounded at a body thereof, so that the photoconductive drum 17 is constructed at the surface portion to form a positively charged photoconductive layer made of material such as polycarbonate.

A charger 18 is disposed over the photoconductive drum 17 to be spaced apart therefrom. The charger 18, which is of a Scorotron-type and for a positive charge, is configured to induce a corona discharge at a charging wire made of material such as tungsten, allowing the photoconductive drum 17 to be charged positively and uniformly on the surface of the photoconductive drum 17.

A transfer roller 19 is disposed under the photoconductive drum 17 in opposed relation therewith. A transfer bias is applied to the transfer roller 19 for transfer.

The photoconductive drum 17 in rotation is initially charged at the surface thereof positively and uniformly by the charger 18. An electrostatic latent image is then formed on the photoconductive drum 17 with the laser light from the scanning unit 10. Subsequently, because of the rotation of the photoconductive drum 17 in contact with the developer roller 14, the toner which has been borne and positively charged on the developer roller 14 is delivered to the electrostatic latent image on the surface of the photoconductive drum 17 and then becomes borne thereon. As a result, a toner image is formed on the surface of the photoconductive drum 17, to thereby achieve a reversal processing. Thereafter, the toner image borne on the surface of the photoconductive drum 17 is transferred to the print sheet 5 by virtue of the transfer bias applied to the transfer roller 19, during the travel of the print sheet 5 between the photoconductive drum 17 and the transfer roller 19.

Figure 2:
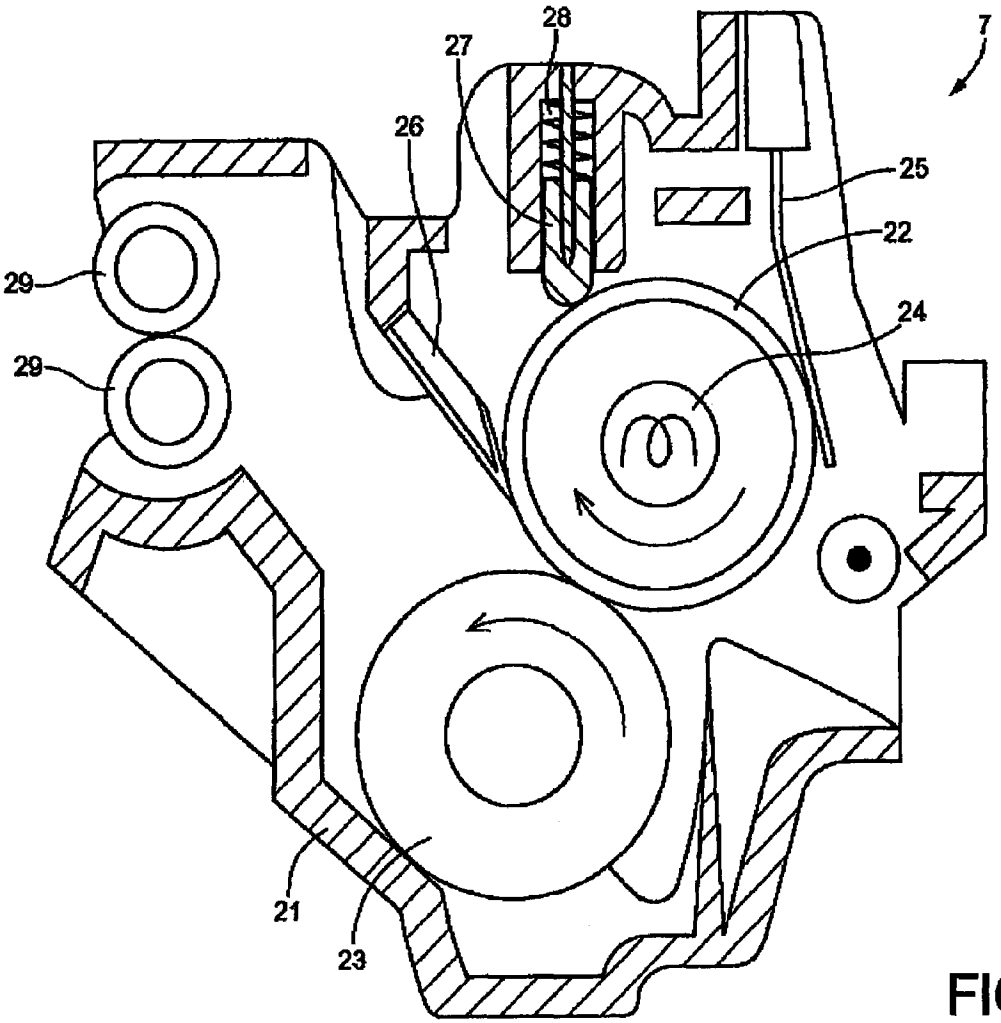
FIG. 2 is an enlarged sectional view illustrating a fuser unit shown in FIG. 1.

The fuser unit 7, although is schematically shown in FIG. 1, is illustrated in FIG. 2 in construction in greater detail. The fuser unit 7 will be described below with reference to FIG. 2.

The fuser unit 7 is disposed downstream from the image forming unit 6 in the direction of the travel path of the print sheet 5. The fuser unit 7 includes within a casing 21 thereof: a fuser roller 22; a pressure roller 23 pressing the fuser roller 22; a heater 24 heating the fuser roller 22; and a thermistor 25 as an example of a temperature sensor. The fuser unit 7 further includes within the casing 21: a skive finger or separator 26; a cleaner 27; and a pair of transport rollers 29, 29 disposed downstream from the fuser roller 22 in the direction of the travel path of the print sheet 5.

The fuser roller 22, which is cylindrically formed with material such as aluminum, is rotatably supported by the casing 21 at both axial ends of the fuser roller 22. The fuser roller 22 is driven for rotation in the direction of the arrow shown in FIG. 2 by virtue of the motive power of a main motor 41(see FIG. 3).

The heater 24, which is a halogen heater, for example, is disposed to extend within the fuser roller 22 along a central axis thereof. The heater 24 is subject to an on-off control based on an output signal of a CPU 32 described later.

The pressure roller 23 is constructed such that an elastic material such as a rubber material is wounded around a metal shaft of the pressure roller 23. The pressure roller 23 below the fuser roller 22, which is pressed onto the fuser roller 22 by means of a spring not shown, is rotatably supported by the casing 21 in pressure contact with the fuser roller 22. As the fuser roller 22 is rotated, the pressure roller 23 is rotated in opposed direction to the rotation of the fuser roller 22 (in the respective directions indicated by the arrows in FIG. 2).

The thermistor 25, which is a temperature sensor of a contact type, is principally formed of an elastic flat plate. The thermistor 25 is rigidly fixed at a base end thereof to the casing 21, while the thermistor 25 is biased at a free end thereof so as to be brought into contact with the surface of the fuser roller 22 at an axially center position thereof. The thermistor 25 detects the surface temperature of the fuser roller 22, and outputs a signal representative of the detected temperature. The signal is periodically retrieved by the CPU 32.

The aforementioned skive finger 26, which is made of material such as synthetic resin, is rigidly fixed to the casing 21 at a base end of the skive finger 26. The skive finger 26 has a sharp top end. The skive finger 26 is arranged, such that the top end is disposed downstream from a contact position of the fuser roller 22 with the pressure roller 23, in the direction of the travel path of the print sheet 5, and such that the top end extends in the opposed direction to the rotation of the fuser roller 22 so as to be brought into contact with the surface of the fuser roller 22. The skive finger 26 functions to peel off the print sheet 5, upon passing through between the fuser roller 22 and the pressure roller 23, from the surface of the fuser roller 22 by means of the sharp top end of the skive finger 26.

The cleaner 27, which is made of elastic material such as rubber material, is attached to a portion of the casing 21 located above the fuser roller 22, via a spring 28. The cleaner 27 is biased toward the fuser roller 22 by an elastically biasing force of the spring 28. The lower or leading end of the cleaner 27 is disposed in contact with the fuser roller 22 at a position downward from the skive finger 26 in rotational direction of the fuser roller 22, so as to extend along the axial direction of the fuser roller 22. Such a construction enables a removal from the fuser roller 22, of a toner which has been attached from the print sheet 5 to the surface of the fuser roller 22.

The fuser unit 7 is operated, in a printing operation (including a fusing operation), such that the on-off control of the heater 24 by the CPU 32 allows the surface temperature of the fuser roller 22 to be maintained at a fusing temperature described below. The fuser unit 7 enables a toner, which has been transferred to the print sheet 5 by the image forming unit 6, to be heated during the passing of the print sheet 5 through between the fuser roller 22 and the pressure roller 23, resulting in the toner being fused to the print sheet 5. The print sheet 5 then exits from the fuser unit 7 because of the rotation of the pair of transport rollers 29, 29.

Figure 3:
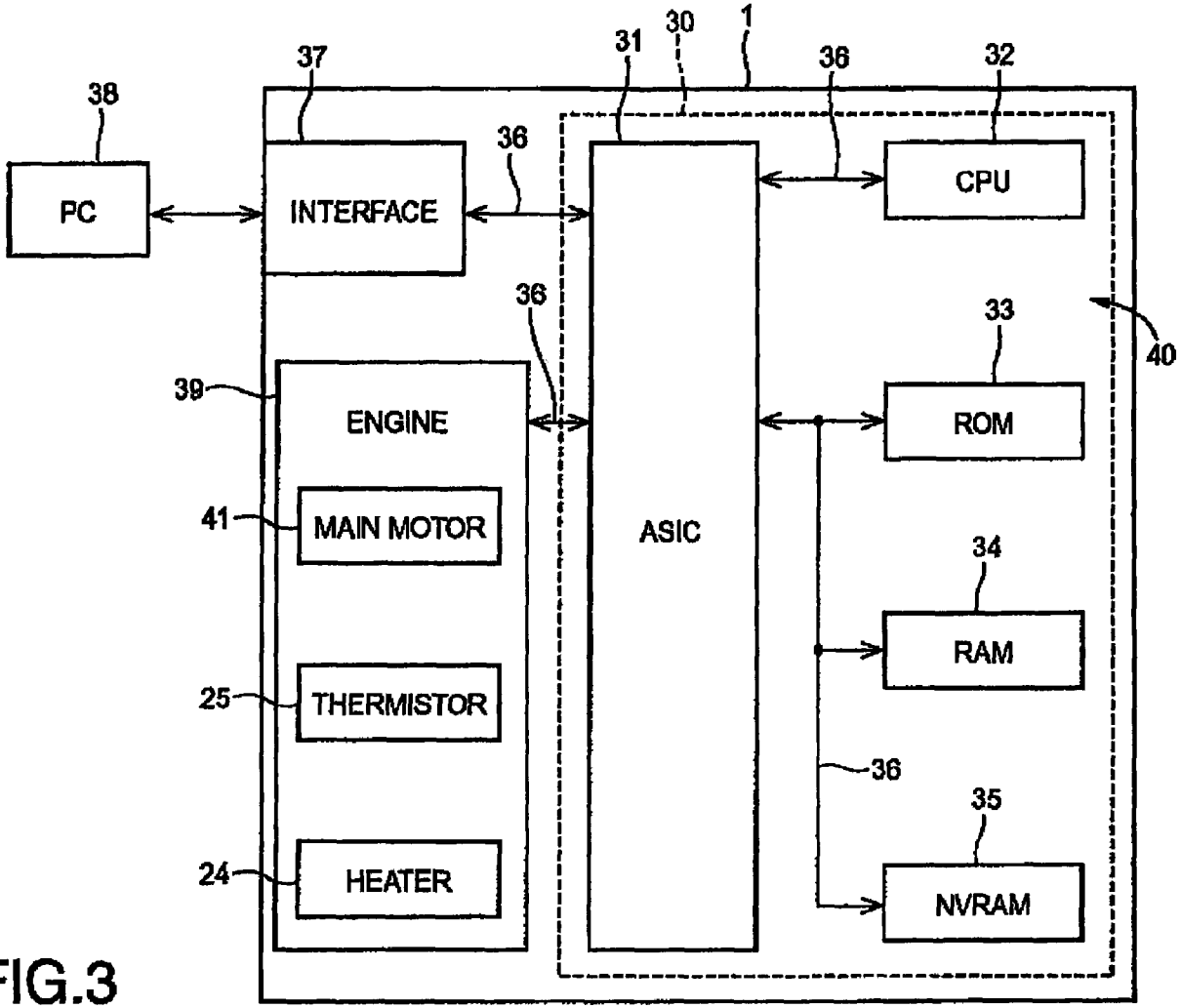
FIG. 3 is a block diagram schematically illustrating the electrical construction of the laser printer shown in FIG. 1.

FIG. 3 schematically shows in block diagram the electrical configuration of the laser printer 1. The laser printer 1 is constructed so as to include: a control board 30; an interface 37; an engine 39; etc.

The control board 30 includes: an ASIC (Application-Specific Integrated Circuit) 31; the aforementioned CPU (Central Processing Unit) 32; a ROM (Read-Only Memory) 33; a RAM (Random Access Memory) 34; and an NVRAM (Non-Volatile RAM) 35.

The ASIC 31 is an integrated circuit connecting the CPU 32 to the ROM 33, the RAM 34, and the NVRAM 35; the interface 37; and the engine 39, respectively. The ASIC 31 is connected on the control board 30 to the CPU 32, the ROM 33, the RAM 34, and the NVRAM 35 via buses 36, 36, respectively, while the ASIC 31 is connected outside the control board 30 to the interface 37 and the engine 39 via the buses 36, 36, respectively. Using the connections between the CPU 32, the ROM 33, the RAM 34, and the NVRAM 35 via the buses 36, 36, a computer 40 is constructed.

Although is described later in greater detail, the CPU 32 serving as the core for the control of the laser printer 1, performs the following functions:

(i) "Temperature Control Function" for controlling the heater 24 such that the temperature of the fuser roller 22 becomes equal to a desired temperature;

(ii) "Cold-start Detecting Function" for detecting the occurrence of a cold start of the fuser unit 7;

(iii) "Timing Measurement Function" for measuring the length of a warm-up time, i.e., an elapsed time required for warm-up during which the temperature of the fuser roller 22 rises from the temperature at the cold start to a normal standby-temperature described later (using "timer for measuring the length of the warm-up time");

(iv) "Heat-storing-period Establishing Function" for establishing a desired length of a "heat-storing period" during which heat is to be stored in the fuser unit 7 by maintaining the temperature of the fuser roller 22 at a second standby-temperature which is higher than the normal standby-temperature;

(v) "Fusing-operation Detecting Function" for detecting the termination of the fusing operation, optionally together with the initiation of the same fusing operation; and (vi) "Desired-standby-temperature Establishing Function" for establishing, upon termination of the fusing operation during the aforementioned "heat-storing period," the desired temperature of the fuser roller 22 so as to be equal to be one of the normal standby-temperature and the second standby-temperature, which one is selected depending upon the kind of the receiver medium (e.g., with respect to the heat capacity of the receiver medium).

The ROM 33 has previously stored therein a variety of programs for the control of the laser printer 1, including a print control program for implementing the printing operation, for example.

The print control program includes a temperature control program for controlling the surface temperature of the fuser roller 22, etc. The print control program and the temperature control program are respectively described later in greater detail.

The RAM 34 is a memory for temporal storage of numerical values and data. The RAM 34 is used for the CPU 32 to write to the RAM 34 the surface temperature of the fuser roller 22 detected by the thermistor 25, etc.

The NVRAM 35 is a Non-Volatile Random Access Memory that holds data once stored, even after the power is removed from the laser printer 1 or after the operation state of the laser printer 1 is reset. The NVRAM 35 is used for the CPU 32 to write to the NVRAM 35, for example, the desired temperature of the fuser roller 22 (described later), etc.

To the interface 37, an external personal computer (hereinafter, abbreviated to "PC") 38 is connected.

The engine 39 is composed of a plurality of elements for performing the printing operation, including a main motor 41 for driving the fuser roller 22, etc. for rotation; the thermistor 25; the heater 24; etc.

In the laser printer 1, the thermistor 25 detects the temperature of the fuser roller 22, and the detected temperature is inputted to the CPU 32 for executing the temperature control program described above. The CPU 32 controls the heater 24 for controlling the surface temperature of the fuser roller 22, such that, once the temperature of the fuser roller 22 reaches an upper limit of the desired temperature, the heater 24 is turned off in response to a signal from the CPU 32, while, once the temperature of the fuser roller 22 drops to an lower limit of the desired temperature, the heater 24 is turned on in response to a signal from the CPU 32.

It is added that the control of the heater 24 is not limited in manner or form to the above-described on-off control, and may be embodied as, for example, an alternative control in which the heat generated from the heater 24 is continuously varied as a result of changes to electric current supplied to the heater 24. The alternative control may be a proportional control, a duty control, for example.

The laser printer 1 is controlled by the CPU 32 retrieving from the ROM 33 and implementing the above-described print control program. An example of the print control program is shown in state transition diagram in FIG. 9, while it is shown in flow chart in FIG. 12.

The print control program serves as a host program to the above-described temperature control program. In the print control program, as described below in greater detail by reference to FIG. 12, the printing operation is performed upon receipt of a print request from the PC 38, and an operation mode of the laser printer 1 is varied accordingly.

In the absence of a print request from the PC 38, the operation mode of the laser printer 1 is set to any one of standby modes. The standby modes, i.e., two kinds of standby-mode, include a "normal standby-mode" in which the desired temperature of the fuser roller 22 is referenced as "normal standby-temperature Tr," and a "second standby-mode" in which the desired temperature of the fuser roller 22 is referenced as "second standby-temperature T1."

Upon reception of a print request from the PC 38, the operation mode of the laser printer 1 is shifted to a print mode. In addition, upon elapse of a predetermined length of time during which the operation mode is kept to be one of the standby-modes, the operation mode is shifted to a sleep mode.

The selection from the operation modes is performed as a result of the operation of the CPU 32 during the execution of the print control program in which the CPU 32 writes a value corresponding to the selected operation mode to a given storage area of the RAM 34, and which the CPU 32 retrieves the value from the RAM 34 during the execution of the aforementioned temperature control program.

The laser printer 1 selectively performs a normal printing in which normal print sheets 5 each having a normal thickness are printed, and a thick paper printing in which thick print sheets are printed, depending upon request from the user. In the thick paper printing, the desired operating temperature of the fuser roller 22 is set to an additional fusing temperature Tp higher than a standard fusing temperature Tp which is a desired operating temperature set for the above normal printing.

Figure 12:
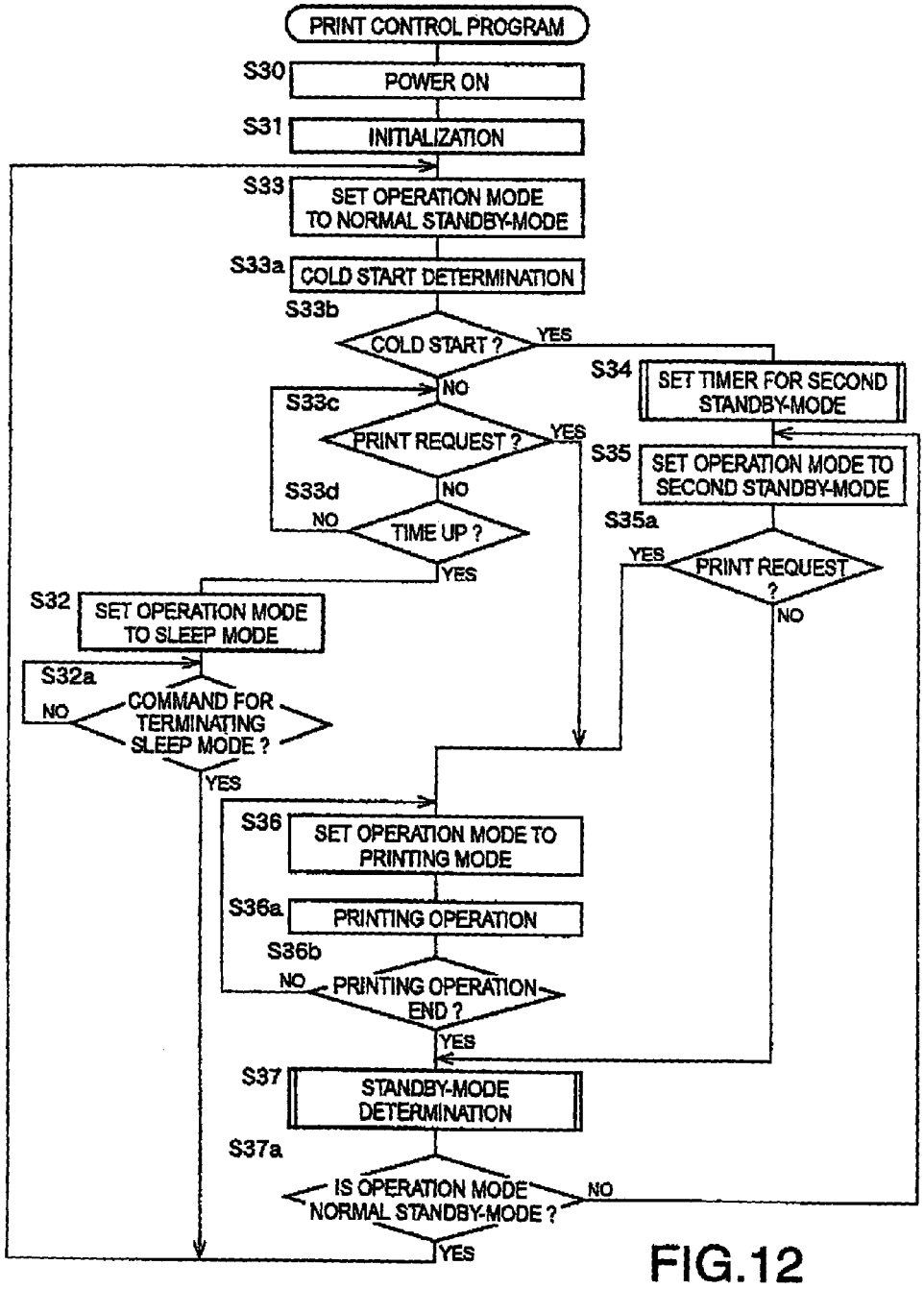
FIG. 12 is a flow chart schematically illustrating the print control program executed by the CPU shown in FIG. 3.

Prior to the shifting of the operation mode of the laser printer 1 to the "second standby-mode" as a result of the execution of the print control program, a step S34 shown in FIG. 12 is implemented to execute the routine for setting timer for second standby-mode, to thereby set a timer for the second standby-mode constructed as a software timer.

The timer for second standby-mode is initiated upon start of the "second standby-mode," and the count value of the timer is sequentially counted down from the initial value, i.e., the set value. At the time that the implementation time of the second standby-mode amounts to a given time ts, the count value of the timer is reduced to "0."

Figure 4:
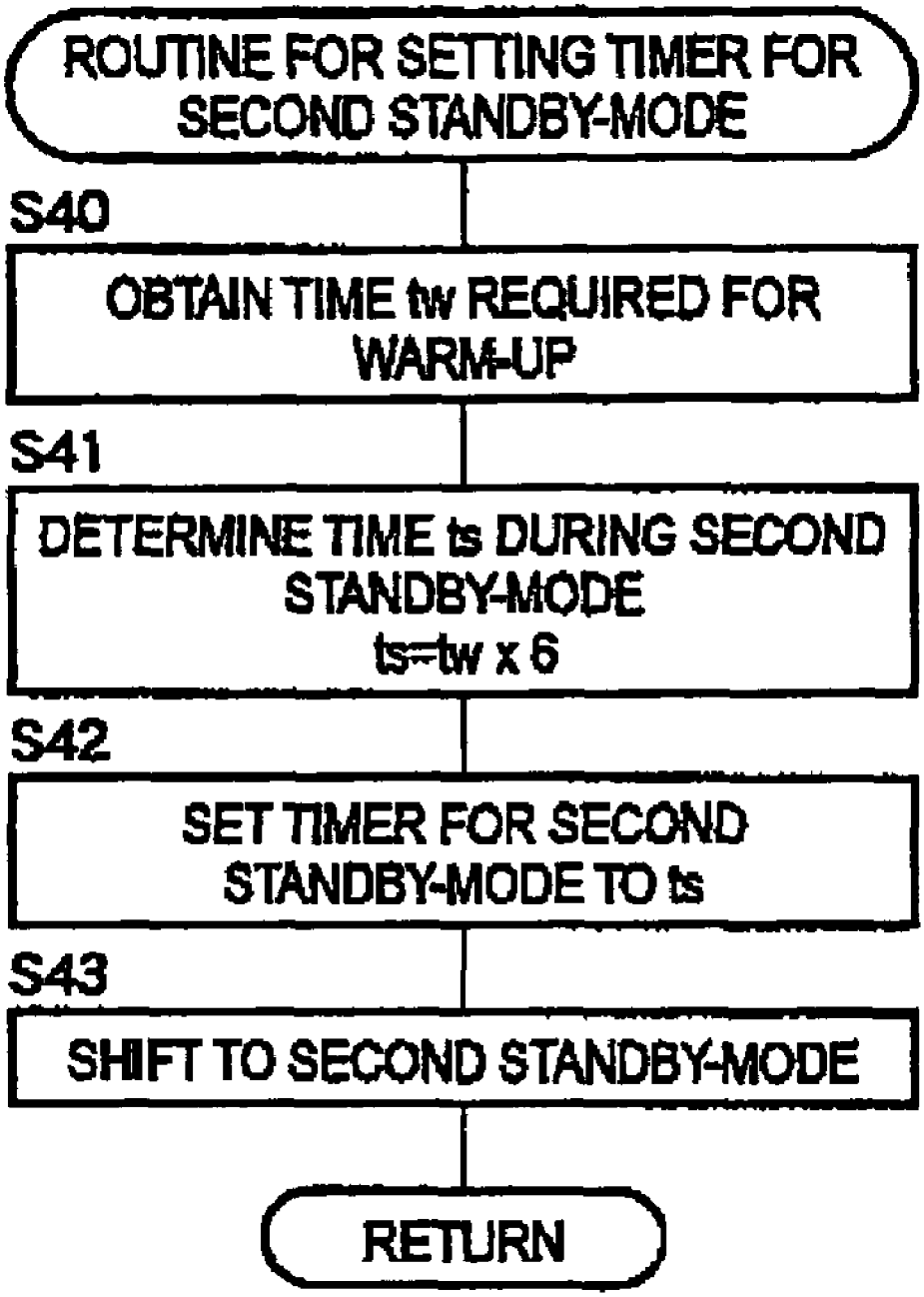
FIG. 4 is a flow chart schematically illustrating a routine for setting a timer for a second standby-mode, which is executed by a CPU shown in FIG. 3.

FIG. 4 shows schematically in flow chart the routine for setting timer for second standby-mode. The execution of the routine is initiated with a step S40 to obtain a warm-up time tw as described later (see FIG. 10). The step S40 is followed by a step S41 to determine the above time ts, by multiplying the obtained warm-up time tw by six, for example. Thereafter, a step S42 is implemented to set the time ts of the timer for second standby-mode to the determined time ts. Subsequently, a step S43 is implemented to shift the operation mode of the laser printer 1 to the second standby-mode.

Upon shifting from the print mode to one of the standby modes after completion of the corresponding printing operation, a step S37 of the print control program shown in FIG. 12 is implemented to execute the standby-mode determination routine, to thereby select any one of the "normal standby-mode" and the "second standby-mode" as the coming operation mode. The standby-mode determination routine is schematically illustrated in flow chart in FIG. 5, as described below in greater detail with reference to FIG. 5.

Then, with reference to FIGS. 6 to 12, the temperature control of the fuser roller 22 will be described in greater detail.

Figure 10:
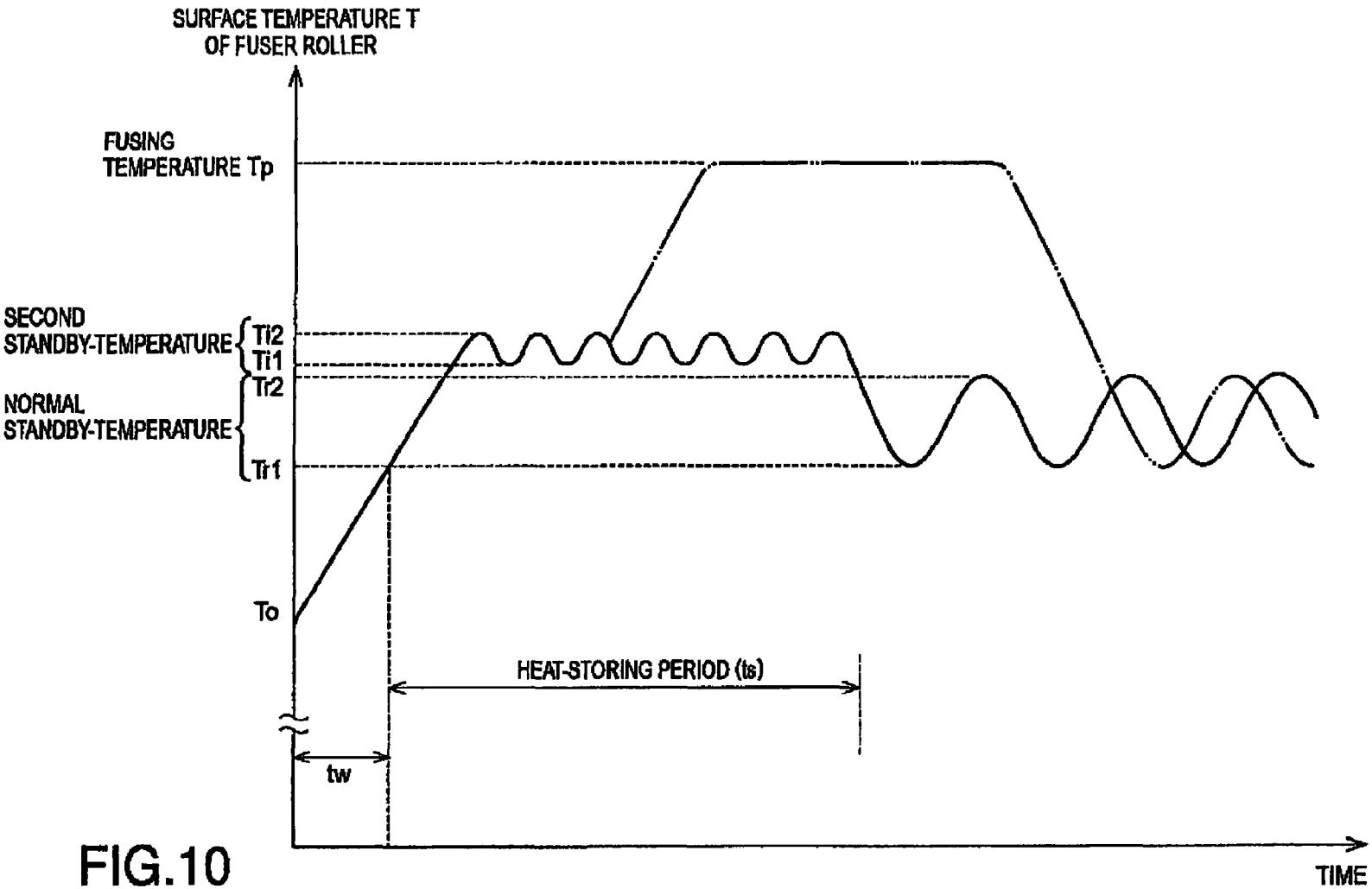
FIG. 10 is a graph showing an example of temporal changes in surface temperature of a fuser roller of the laser printer shown in FIG. 1.

Describing firstly the definitions of various terms used herein, the desired temperatures, three in kind, which are the targets of the control of the fuser roller 22, include, as shown in FIG. 10, the fusing temperature Tp, the normal standby-temperature Tr, and the second standby-temperature Ti. For each of these temperatures, there are provided two values, i.e., a lower limit (represented by "1" suffixed onto the symbol indicative of the corresponding temperature), and an upper limit (represented by "2" suffixed onto the symbol indicative of the corresponding temperature).

The fusing temperature Tp is a desired temperature to be achieved in heat fusing an unfused toner image onto the print sheet 5 during the printing operation (including the fusing operation). The actual temperature of the fuser roller 22 is preferably stable during the fusing operation as much as possible, for a reduced temporal change in conditions of fixed toner.

To this end, the lower and upper limits of the fusing temperature Tp are set so as to be approximately equal to each other (e.g., Tp=213° C.). Where the "thick paper printing" in which a thick paper larger in heat capacity than a normal print sheet is printed, as described above, the fusing temperature Tp is set to a temperature (e.g., Tp=220° C.). higher than the standard fusing temperature for printing the normal print sheet.

The normal standby-temperature Tr and the second standby-temperature T1 are each a desired temperature in a standby-mode. These desired temperatures are set in level so as to eliminate the power consumption because of the surface temperature T of the fuser roller 22 being maintained lower than the fusing temperature Tp while the printing operation is inactive. These desired temperatures are set in level, so that the surface temperature of the fuser roller 22 can be raised rapidly to the fusing temperature Tp upon the printing operation becoming active. More specifically, the normal standby-temperature Tr is set, such that the lower limit Tr1=165° C., and the upper limit Tr2=180° C., for example.

Referring specially to the second standby-temperature T1, it is set in level so as to allow the surface temperature of the fuser roller 22 to be maintained at a temperature higher than the normal standby-temperature Tr at a cold start from an power-on event of the laser printer 1 and the release of the operation mode from the sleep mode, to thereby warm up not only the fuser roller 22 within the fuser unit 7 but also the remaining portion of the fuser unit 7. The desired temperature of the fuser roller 22 is maintained at the second standby-temperature Ti throughout a given length of period following the initiation of the cold start (hereinafter, referred to as "heat-storing period"). More specifically, the second standby-temperature Ti is set, such that the lower limit Ti1=180° C., and the upper limit Ti2=185° C., for example.

Figure 6:
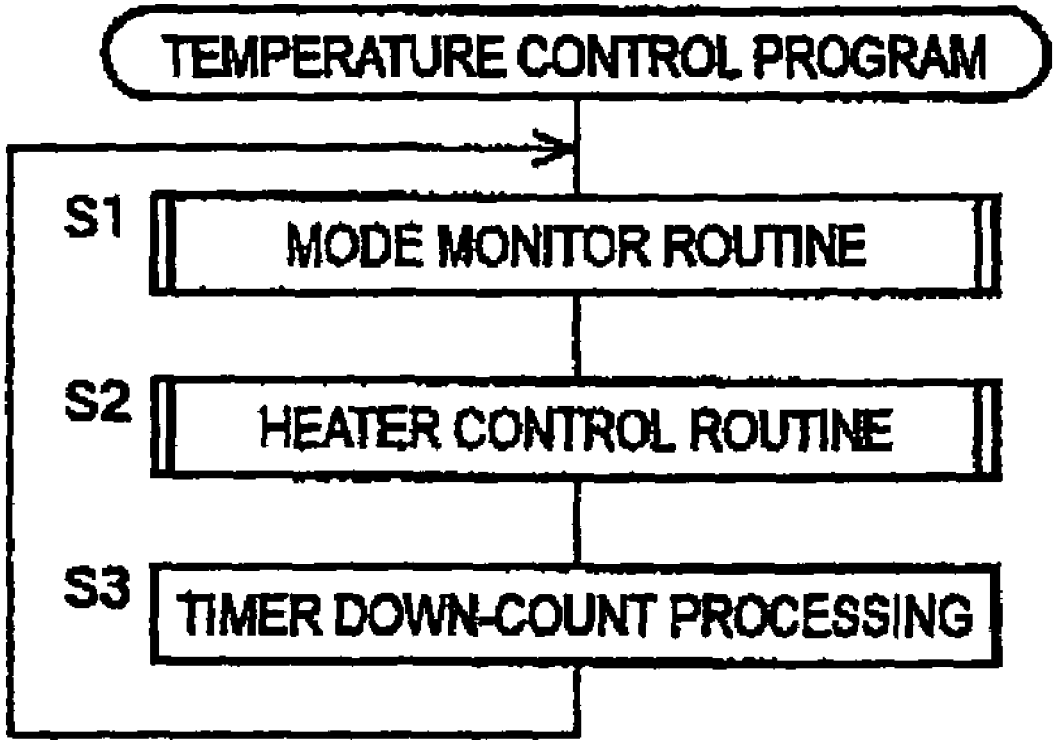
FIG. 6 is a flow chart schematically illustrating a temperature control-program executed by the CPU shown in FIG. 3.

The temperature control of the fuser roller 22 is performed as a-result of the execution of the aforementioned temperature control program shown in FIG. 6. The temperature control program is repeatedly executed by the use of a timer interruption function of the CPU 32, every 5 ms, for example. At each cycle of the execution of the temperature control program, the CPU 32 sequentially executes a mode monitor routine of a step S1, a heater control routine of a step S2, and a timer down-count processing of a step S3.

Figure 7:
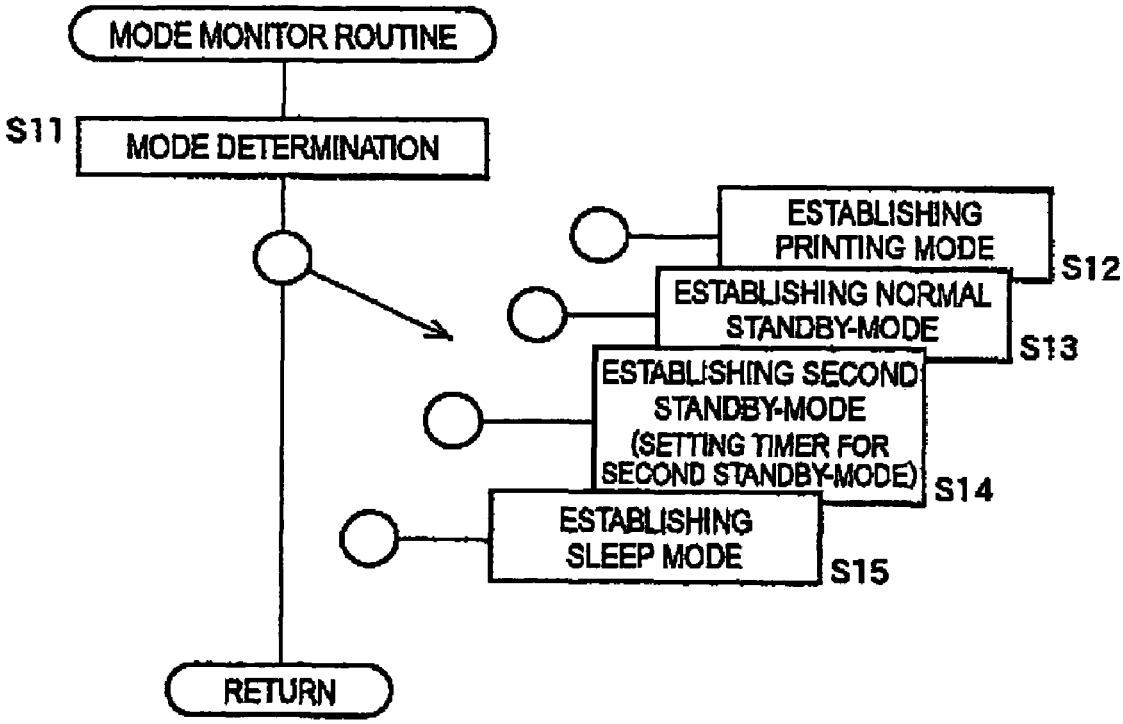
FIG. 7 is a flow chart schematically illustrating a mode monitor routine executed by the CPU shown in FIG. 3.

FIG. 7 shows schematically in flow chart the details of the mode monitor routine. The execution of the mode monitor routine is initiated with a step S11 to read the operation mode established as a result of the execution of the aforementioned print control program, to thereby determine or identify the current operation mode of the laser printer 1.

Depending upon the determination of the step S11, the CPU32 proceeds to a corresponding one of steps S12 to S15. If the step S12 is selected, the print mode is established, if the step S13 is selected, the normal standby-mode is established, if the step S14 is selected, the second standby-mode is established, and, if the step S15 is selected, the sleep mode is established, all as an active operation mode of the laser printer 1.

More specifically, if the step S12 is selected, the desired temperature of the fuser roller 22 is set to the fusing temperature Tp (e.g., 213° C.), for establishment of the print mode. If the step S13 is selected, the desired temperature of the fuser roller 22 is set to the normal standby-temperature Tr (e.g., lower limit Tr1=165° C., upper limit Tr2=160° C.), for establishment of the normal standby-mode. If the step S14 is selected, the desired temperature of the fuser roller 22 is set to the second standby-temperature Ti (e.g., lower limit Ti1=180° C., upper limit Ti2=185° C.), for establishment of the second standby-mode. These establishments are performed by storing in a storage area of the NVRAM 35 a unique value to the established one of the optional operation modes. If the step S15 is selected, the heater 24 is deactivated (turned off, in the present embodiment) for establishment of the sleep mode.

Figure 8:
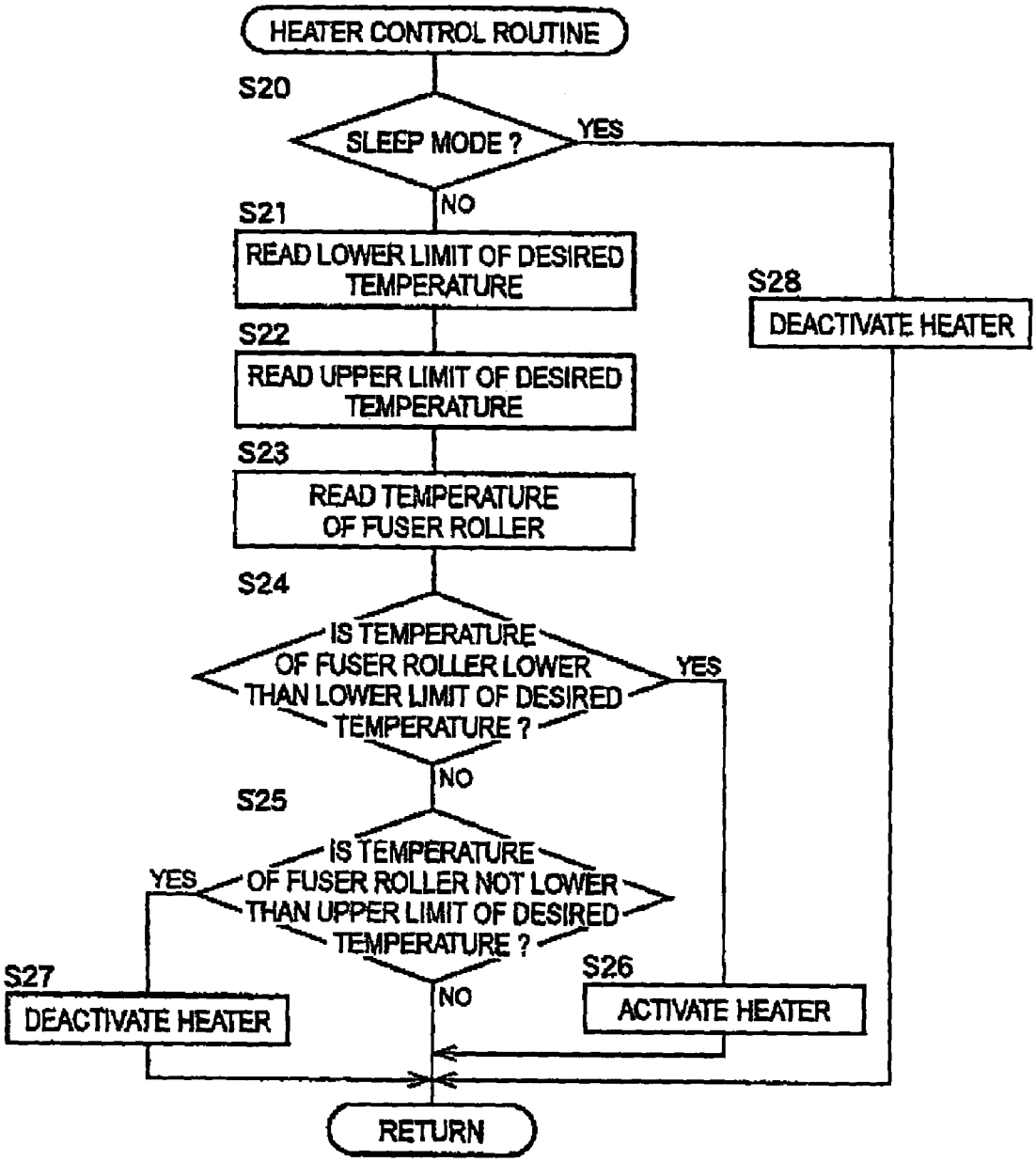
FIG. 8 is a flow chart schematically illustrating a heater control program executed by the CPU shown in FIG. 3.

FIG. 8 shows schematically in flow chart the details of the heater control routine. The execution of the heater control routine is initiated with a step S20 to determine whether or not the current operation mode of the laser printer 1 is the sleep mode. If the current operation mode is not the sleep mode, then the determination of the step S20 becomes negative "NO," and the CPU 32 proceeds to a step S21.

The step S21 is implemented to read from the NVRAM 35 the lower limit of the desired temperature currently active. Thereafter, a step S22 is implemented, likewise, to read from the NVRAM 35 the upper limit of the desired temperature currently active. Subsequently, a step S23 is implemented to read temperature information obtained from the thermistor 25, which is to say, the temperature of the fuser roller 22 detected by the thermistor 25 (hereinafter, referred to simply as "fuser roller temperatures").

The step S23 is followed by steps S24 to S27 to control the temperature of the fuser roller 22 by means of an on-off control of the heater 24.

More specifically, the step S24 is implemented to determine whether or not the detected value of the fuser roller temperature is lower than the lower limit of the current desired temperature. If the detected value is lower than the lower limit, then the determination of the step S24 becomes affirmative "YES," and the step S26 is implemented to activate (turn on, in the present embodiment) the heater 24.

On the other hand, if the detected value of the fuser roller temperature is not lower than the lower limit of the current desired temperature, then the determination of the step S24 becomes negative "NO," and the step S25 is implemented to determine whether or not the detective value of the fuser roller temperature is not lower than the upper limit of the current desired temperature. If the detective value is not lower than the upper limit, then the determination of the step S25 becomes affirmative "YES," and the step S27 is implemented to deactivate the heater 24.

If the determinations of the steps S24 and S25 are both negative "NO," because the detected value of the temperature of the fuser roller 22 is not lower than the lower limit of the desired temperature, and lower than the upper limit, then the steps S26 and S27 are skipped, resulting in, in this case, the on/off state of the heater 24 being maintained.

The on-off control of the heater 24 described above allows the actual temperature of the fuser roller 22 to be maintained at the desired temperature.

Although the heater control routine has been described above about the case where the operation mode of the laser printer 1 is not the sleep mode, if the operation mode is the sleep mode, then the determination of the step S20 becomes affirmative "YES," and a step S28 is implemented to deactivate the heater 24. As a result, the actual temperature of the fuser roller 22 is allowed to naturally drop.

Upon execution of the first cycle of the heater control routine after the operation mode of the laser printer 1 was shifted to the "normal standby-mode," a step S33*a* of the print control program shown in FIG. 12 is implemented. The step S33*a* is implemented if it is immediately after a power-on event of the laser printer 1, or if the operation mode has returned from the sleep mode. Together with the implementation of the step S33*a*, a cold-start determination is performed as described below.

In the cold-start determination, initially, a software timer which is configured as a separate computer-implemented process, is initiated at the time that the operation mode is set to the "normal standby-mode." The software timer is used to measure the length of the aforementioned warm-up time tw elapsed until the actual temperature of the fuser roller 22 amounts to the lower limit Tr1 of the desired temperature during the normal standby-mode. If the measured length of the warm-up time tw is longer than a predetermined length of time, then it is determined that a "cold start" is experienced.

If the step S33*a* determines that a cold start is experienced, then the determination of the following step S33*b* becomes affirmative "YES," and a step 535 is implemented after a step S34, to shift the operation mode of the laser printer 1 from the "normal standby-mode" to the "second standby-mode."

On the other hand, if the step S33*a* determines that a cold start is not experienced because the measured value of the warm-up time tw is not longer than the predetermined length of time, then the determination of the step S33*b* becomes negative "NO," and the operation mode is unchanged to be the "normal standby-mode."

Figure 9:
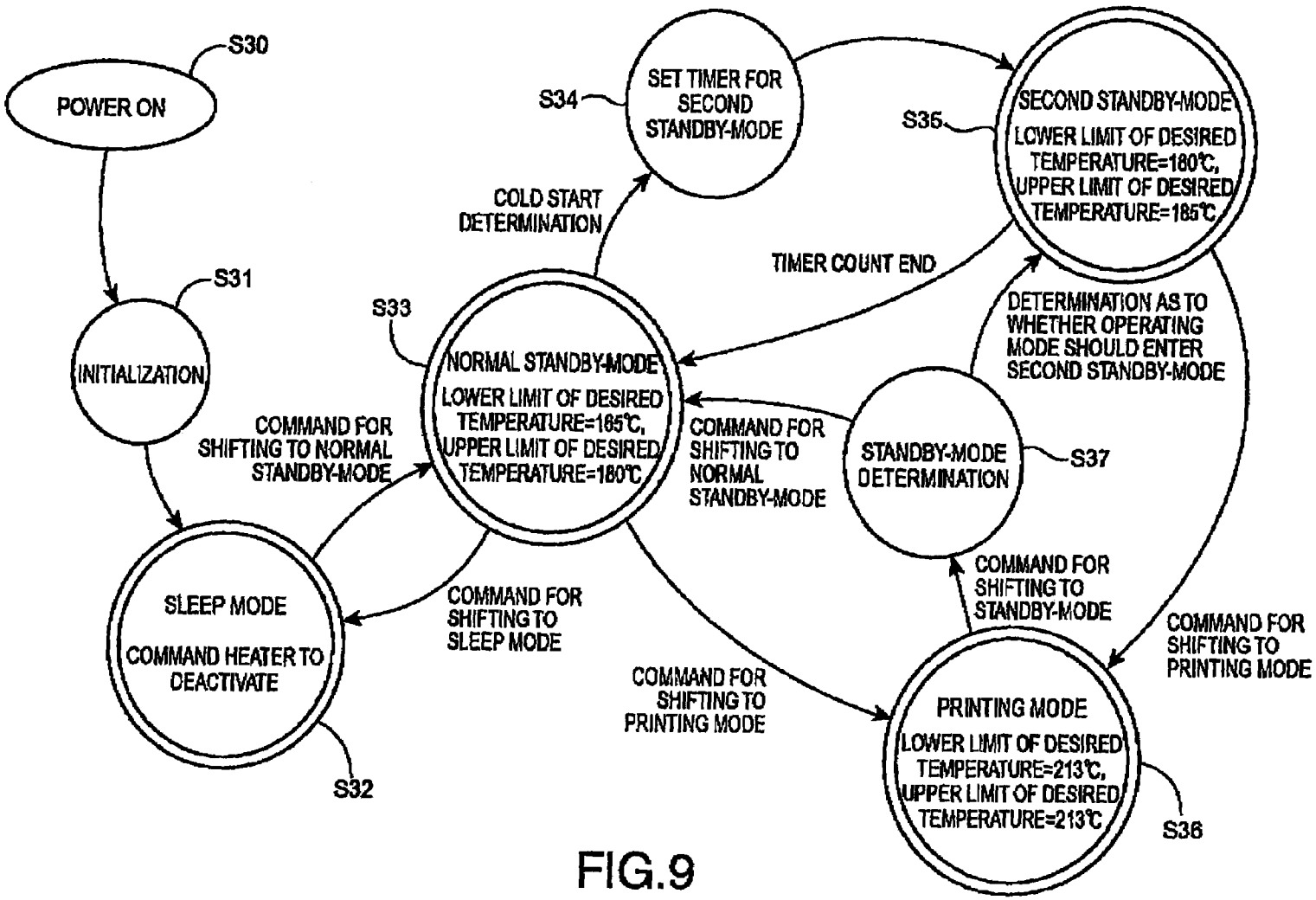
FIG. 9 is a state transition diagram for explaining a print control program executed by the CPU shown in FIG. 3 and shifting between operation modes of the laser printer shown in FIG. 1.

Then, the print control program illustrated in flow chart in FIG. 12 will be described below in greater detail with reference to the state transition diagram shown in FIG. 9.

As shown in FIG. 12, the execution of the print control program is initiated with a step S30 wherein the laser printer 1 is powered on, and then a step S31 is implemented to initialize the laser printer 1 in a predetermined manner. Thereafter, a step S33 is implemented to immediately shift the operation mode of the laser printer 1 to the normal standby-mode.

Upon the implementation of the step S33 being followed by the execution of the mode monitor routine (see FIG. 7) of the aforementioned temperature control program, the mode determination of the step S11 is performed to determine that the current operation mode of the laser printer 1 is the normal standby-mode. Accordingly, the normal standby-mode is established in the step S13. More specifically, the desired temperature of the fuser roller 22 is set such as the lower limit Tr1=165° C.), while the upper limit Tr2=180° C.). The execution of the aforementioned heater control routine (see FIG. 8) in view of these values allows the heater 24 to be continuously energized, resulting in a rapid rise in temperature of the fuser roller 22.

On the other hand, with the initiation of the "normal standby-mode," the step S33*a* is implemented for the "cold-start determination as shown in FIG. 12, as described above. During a period after a power-on event of the laser printer 1, the temperature thereof is entirely lower, and the temperature of the fuser roller 22 is also lower.

As a result, there is relatively long the warm-up time tw elapsed until the actual temperature of the fuser roller 22 amounts to the lower limit Tr1 of the desired temperature for the "normal standby-mode." The current cycle of the "cold-start determination" is therefore performed to determine that a "cold start" is experienced. Accordingly, the determination of the step S33*b* becomes affirmative "YES," and the implementation of the steps S34 and S35 shifts the operation mode of the laser printer 1 to the "second standby-mode."

Upon the steps S34 and S35 being followed by the mode monitor routine (see FIG. 7) of the aforementioned temperature control program, the mode determination of the step S11 is effected and then detects a shifting of the operation mode from the "normal standby-mode" to the "second standby-mode."

Therefore, the second standby-mode is established in the step S14. More specifically, the upper and lower limits of the desired is temperature of the fuser roller 22 are set so as to be higher than the corresponding respective values for the "normal standby-mode." The desired temperature of the fuser roller 22 is set such that the lower limit Ti1=180° C., while the upper limit Ti2=185° C., for example. For the reasons, the actual temperature of the fuser roller 22 is maintained at a temperature (between 180° C. and 185° C.) higher than that of the "normal standby-mode (between 180° C. and 185° C.). See a portion of the graph illustrated by a solid line in FIG. 10, which corresponds to the heat-storing period.

Upon issue of a print request from the PC 38 with the operation mode of the laser printer 1 being the "second standby-mode," the determination of a step S35*a* of the print control program shown in FIG. 12 becomes affirmative "YES." The step S35*a* is followed by a step S36 to shift the operation mode to the "print mode." Thereafter, a step S36*a* is implemented to perform a printing operation.

By the execution of the mode monitor routine of the temperature control program, it is determined that the operation mode has been shifted to the "print mode." As a result, the print mode is established in the step S12, whereby the desired temperature of the fuser roller 22 is set to the fusing temperature Tp (213° C.) higher than that of the "second standby-mode." Upon execution of the heater control routine concurrently, the actual temperature of the fuser roller 22 is raised to the fusing temperature Tp (see the graph depicted by a two-dotted line in FIG. 10). In the current print mode, the print sheet 5 is fed into between the fuser roller 22 and the pressure roller 23, to thereby perform the fusing operation.

As described above, the desired temperature for the "second standby-mode", which ranges between 180° C. and 185° C., is set to be higher than the desired temperature of the "normal standby-mode," which ranges between 165° C. and 180° C.). For the reason, the laser printer 1 is warmed up by the use of the "second standby-mode" at a cold start, and the adequate heat is applied from the fuser roller 22 to the ambient, during the heat-storing period in which the operation mode of the laser printer 1 is maintained to be the "second standby-mode," resulting in the fuser unit 7 being entirely warmed up.

For the above reasons, even where a print request is issued from the PC 38 firstly after a power-on event of the laser printer 1, the fuser roller 22 is allowed to be reduced in heat removed from the fuser roller 22 by the ambient in the course of the temperature rise of the fuser roller 22 up to the fusing temperature Tp. As a result, the actual temperature of the fuser roller 22 is secured to be raised to the fusing temperature Tp, avoiding inadequate fixing.

It is of course that, because the heater 24 is controlled so that the actual temperature of the fuser roller 22 may be maintained at the second standby-temperature higher than the normal standby-temperature during the heat-storing period prior to the coming "print mode," the fuser roller 22 is allowed to be heated up to the fusing temperature Tp faster than when the fuser roller 22 is heated up from the normal standby-temperature to the fusing temperature Tp. This would contribute to reduction in length of time for which the user has to wait from a power-on event of the laser printer 1 until an actual start of printing operation.

In the present-embodiment, the difference between the upper limit (185° C.) and the lower limit (180° C.) of the desired temperature for the "second standby-mode," i.e., the width of a dead band (hereinafter, also referred to as "allowable range of desired temperature") is set to as small as 5° C., which is smaller than a dead band for the "normal standby-mode" of 15° C. This is for avoiding inadequate fixing more securely. The reasons will be described in more detail.

Where the width of the dead band is set to be as large as that of the "normal standby-mode," if the fuser roller 22 is heated up from a temperature in the vicinity of the upper limit Ti2 of the second standby-temperature, the surface of the fuser roller 22 is brought into an overheat condition in which the surface temperature T of the fuser roller 22 becomes higher than the fusing temperature Tp, immediately after the initiation of the fusing operation. The occurrence of the overheat condition may possibly entail the re-attachment of a toner image from the fuser roller 22 to the print sheet 5.

On the other hand, if the fuser roller 22 is heated up from a temperature in the vicinity of the lower limit Ti1 of the second standby-temperature, the surface temperature of the fuser roller 22 tends to become lower than the fusing temperature Tp, immediately after the initiation of the fusing operation. This possibly results in inadequate fixing.

In view of the above findings, in the present embodiment, the width of the dead band for the "second standby-mode" is set to be smaller than that of the "normal standby-mode," and therefore, there are allowed to be restricted variations in the surface temperature T of the fuser roller 22 immediately after the initiation of the fusing operation. Accordingly, this avoids inadequate fixing of toner due to excessive variations in the surface temperature T of the fuser roller 22.

In the absence of a print request from the PC 38 even after the laser printer 1 is powered on and then a process of warming up the laser printer 1 in the "second standby-mode" is completed, the operation mode of the laser printer 1 returns to the "normal standby-mode" in a manner described below.

Prior to the shifting of the operation mode to the "second standby-mode" as a result of the implementation of the step S35 shown in FIG. 12, there is executed the step S34, i.e., the routine for setting timer for second standby-mode shown in FIG. 4. Once the step S42 shown in FIG. 4 is implemented, the timer for the second standby-mode is activated after the initial count value is set to the aforementioned time ts.

Subsequently, once the temperature control program shown in FIG. 6 is executed, the step S3 is implemented to perform the aforementioned timer down-count processing for the timer for the second standby-mode. Thereafter, once the print control program shown in FIG. 12 is executed, the step S37 is implemented to execute the standby-mode determination routine. The standby-mode determination routine, which is illustrated schematically in flow chart in FIG. 5, will be described later with reference to FIG. 5. Once the standby-mode determination routine is executed, a step S50 is implemented to monitor the timing that the timer for second standby-mode times-up.

Figure 5:
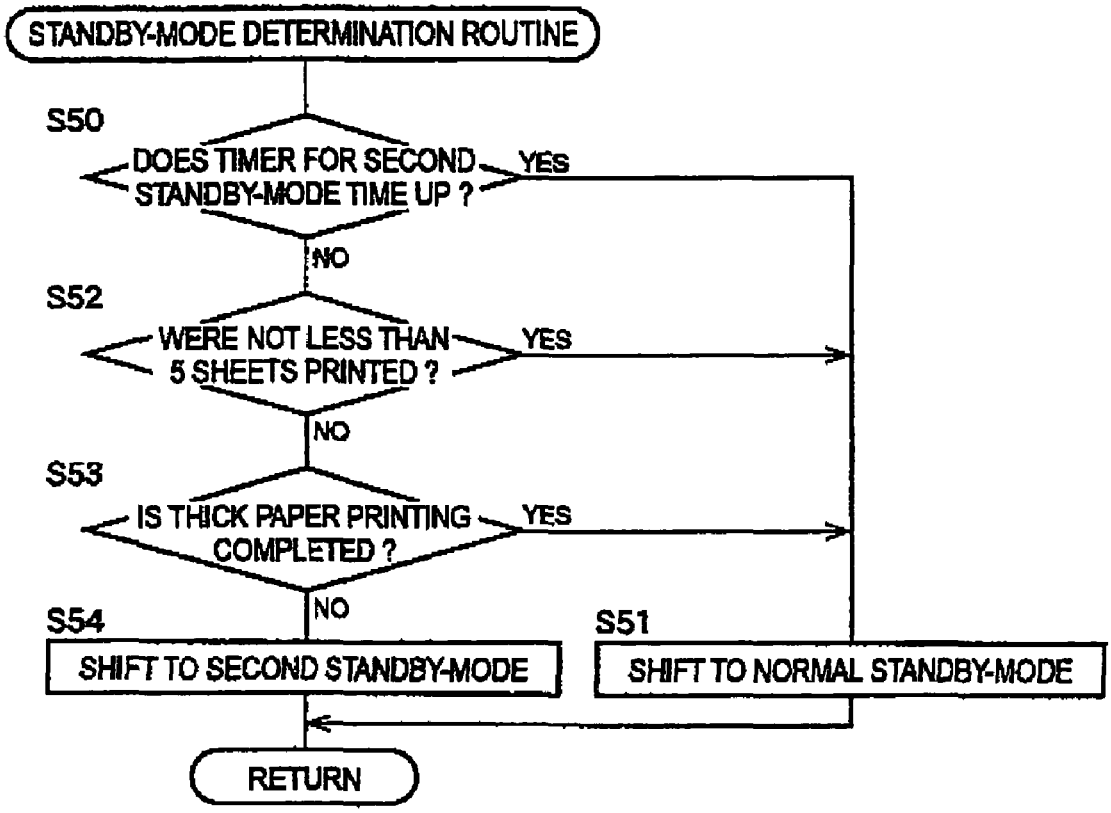
FIG. 5 is a flow chart schematically illustrating a standby-mode determination routine executed by the CPU shown in FIG. 3.

Once the time ts elapses from the initiation of the "second standby-mode," the count value of the timer for second standby-mode becomes "0." As a result, a step S51 shown in FIG. 5 is implemented to return the operation mode of the laser printer 1 to the "normal standby-mode." The reasons will be described below in more detail.

The maintenance of the operation mode of the laser printer 1 at the "second standby-mode" for the time ts allows heat generated from the fuser roller 22 to spread over the entire fuser unit 7. For the reason, even where the operation mode of the laser printer 1 is maintained to be the "normal standby-mode," the desired temperature for which is relatively low, during a ready state of the laser printer 1, the actual temperature of the fuser roller 22 is allowed to be rapidly increased to a temperature required for the "print mode."

In view of the above, in the present embodiment, the laser printer 1 is configured such that operation mode thereof returns to the "normal standby-mode," provided that the time ts has elapsed from the beginning of the newest "second standby-mode." This facilitates reduction in power consumption of the laser printer 1 during the above ready state.

More specially, in the present embodiment, as shown in FIG. 4, the length of the time ts elapsed during the operation mode of the laser printer 1 returns from the "second standby-mode" to the "normal standby-mode" is defined as a function of the aforementioned warm-up time tw (indicating that the length of the time ts equals six times the length of the warm-up time tw, in the present embodiment).

While the ambient temperature is lower, the temperature of the entire laser printer 1 is also lower, and therefore the warm-up time tw is required to be longer. For the reason, the setting of the length of the time ts so as to be longer than and to be varied depending on the length the required warm-up time tw allows the length of the period during which the "second standby-mode" is maintained, i.e., the length of the heat-storing period to be longer than and to be varied depending on the length the required warm-up time tw.

During the heat-storing period, the entire laser printer 1 can be adequately pre-heated, and therefore, even while the ambient temperature is lower, the temperature of the fuser roller 22 is allowed to be rapidly varied from the desired temperature (ranges between 165° C. and 180° C.) for the "normal standby-mode" to the desired temperature (213° C.) for the "print mode."

In addition, while the ambient temperature is higher, the length of the warm-up time tw is required to be shorter, resulting in a reduced length of the duration time of the second standby-mode, i.e., the heat-storing period. This allows the laser printer 1 to become power-saving.

Describing specially, in the present embodiment, the width of the dead band for the on-off control during the "normal standby-mode," i.e., the difference between the upper limit Tr2 and the lower limit Tr1) is set to 15° C., which is larger than that of "second standby-mode" which is 5° C. For the reason, the frequency in alternate changes between on and off states of the heater 24 is reduced, and therefore, the frequency in flickers of the room lights is also reduced.

Upon issue of a print request from the PC 38 during the implementation of the "normal standby-mode" following the "second standby-mode," the laser printer 1 performs the fusing operation, after the shifting of the operation mode of the laser printer 1 to the "print mode." In this case, the width of the dead band for the on-off control is larger in the "normal standby-mode" followed by the "print mode" than that of the "second standby-mode," as described above. Therefore, there will be discussed the possibility that the aforementioned problem of inadequate fixing is brought about in the case where the operation mode of the laser printer 1 is shifted from the "second standby-mode" to the "print mode."

At the time that a print request is issued from the PC 38 during the implementation of the "normal standby-mode" following the "second standby-mode," the fuser unit 7 has been already subject to an adequate heat-storage for the preceding heat-storing period. Therefore, the variations are restricted which occur immediately after the initiation of the fusing operation in the surface temperature T of the fuser roller 22 due to the existing width of the dead band, resulting in no fear of inadequate fixing, as with the case described above.

As described above, upon the "normal standby-mode" being maintained for a predetermined length of time, the timer which is to be counted down for detection of an elapse of the predetermine length of time times-up, and as a result, the determination of a step S33*d* shown in FIG. 12 becomes affirmative "YES." Thereafter, a step S32 is implemented to shift the operation mode to the "sleep mode."

Upon issue of a command from the PC 38 for terminating the sleep mode during the existing "sleep mode," the determination of a step S32*a* becomes affirmative "YES," and the step 533 is implemented, as with the case where the laser printer 1 has been just powered on, to shift the operation mode to the "normal standby-mode." Subsequently, the step S33*a* is implemented to perform the "cold-start determination."

If it is determined in the step S33*a* that a cold start is experienced, then the determination of the step S33*b* becomes affirmative "YES," and the step S33*b* is followed by the steps S34 and S35 to shift the operation mode of the laser printer 1 to the "second standby-mode." Subsequently, if the step S35*a* determines whether or not a print request is issued, the determination of the step S35*a* becomes affirmative "YES," and subsequently a step S36 is implemented to shift the operation mode to the "print mode."

On the contrary, if it is not determined in the step S33*a* that a cold start is experienced, then the determination of the step S33*b* becomes negative "NO." In this case, if a step S33*c* determines whether or not a print request is issued, the determination of the step S33*c* becomes affirmative "YES," and a step S36 is implemented to shift the operation mode of the laser printer 1 to the "print mode." That is, in this case, the operation mode is shifted directly from the "sleep mode" to the "print mode," without an experience of the "second standby-mode."

Therefore, where the laser printer 1 has been cooled down in the vicinity of the fuser unit 7 during the "sleep mode," the "print mode" is experienced after the heat-storing period elapsed in the "second standby-mode." In this case, inadequate fixing is surely avoided, similarly with a case where a printing operation is performed in response to issue of a print request immediately after a power-on event of the laser printer 1.

In addition, where heat remains in the laser printer 1 in the vicinity of the fuser unit 7, similarly with a case where a print request is issued in a short time after the shifting of the operation mode of the laser printer 1 to the "sleep mode," the "print mode" is experienced without an experience of the "second standby-mode." This contributes to reduction in power consumption of the laser printer 1.

After completion of a fusing operation during the "print mode," once a step S36*b* of the print control program determines whether or not the current job of the printing is completed, the determination of the step S36*b* becomes affirmative "YES," and the standby-mode determination routine shown in FIG. 5 is implemented in the step S37. This provides the following functions and effects:

Where a print request was issued on just before the end of the heat-storing period, the count value of the aforementioned timer for second standby-mode is already "0" at the end of a fusing operation initiated in response to the issued print request, and therefore, the determination of the step S50 shown in FIG. 5 becomes affirmative "YES." As a result, the following implementation of a step S51 shifts the operation mode of the laser printer 1 to the "normal standby-mode."

At a time just before the end of the heat-storing period, the actual temperature of the fuser roller 22 had been maintained at the second standby-temperature Ti for an adequately long time, and therefore, an event of the heat-storing of the fuser unit 7 had been adequately experienced.

Therefore, though a shifting is made of the operation mode of the laser printer 1 to the "normal standby-mode" after the end of the previous fusing operation of the fuser unit 7, a rapid rise in the actual temperature of the fuser roller 22 to the fusing temperature Tp is allowed during the current fusing operation in response to issue of a print request after the above shifting, without inadequate fixing. This reduces power consumption of the laser printer 1 more than when the operation mode is shifted to the "second standby-mode."

In view of the above findings, the present embodiment is operated, such that, upon issue of a print request just before the end of a fusing operation of the fuser unit 7, the operation mode of the laser printer 1 is shifted to the "normal standby-mode."

In addition, where a print request was issued in the course of a heat-storing period of the fuser unit 7, where the count value of the aforementioned timer for second standby-mode is not yet "0" at the end of a fusing operation initiated in response to the issued print request, and where the determination of the step S50 therefore becomes negative "NO," a step S52 determines, based on the number of the total pages printed (i.e., the page count of the printed sheets), whether the operation mode of the laser printer 1 should be shifted to the "normal standby-mode" or otherwise the "second standby-mode."

More specifically, the step S52 is implemented to determine whether the page count of the printed sheets is equal to or greater than five. If the page count is equal to or larger than five, then the determination of the step S52 becomes affirmative "YES." In addition, it is reasonably assumed, in this case, that an event of the heat-storing of the fuser unit 7 has been adequately experienced, because the actual temperature of the fuser roller 22 has been maintained at the fusing temperature Tp for a relatively long time.

Figure 11A:
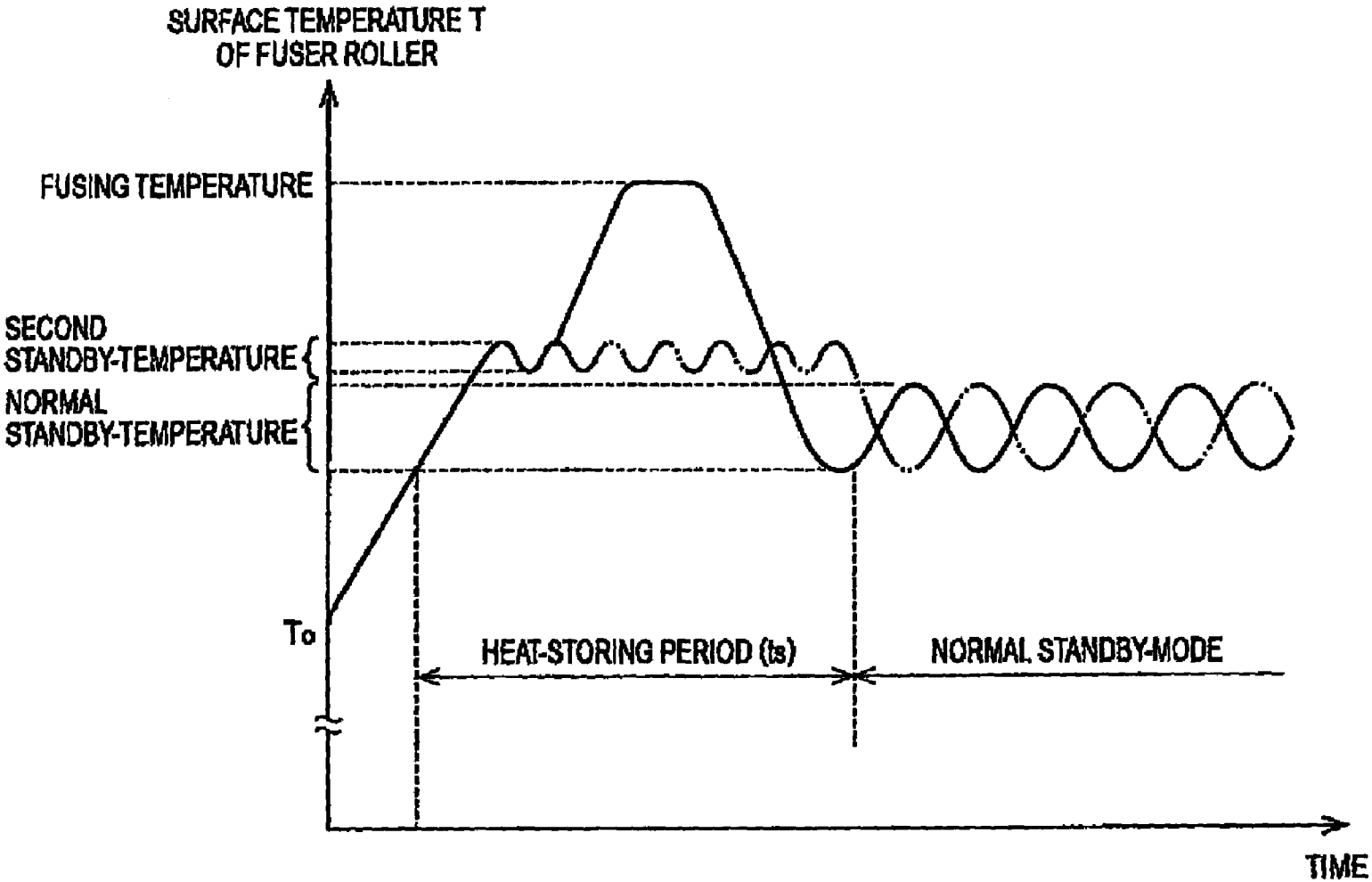
FIG. 11A is a graph showing another example of temporal changes in surface temperature of the fuser roller of the laser printer shown in FIG. 1.

Therefore, the step S51 is therefore implemented to make a shifting of the operation mode of the laser printer 1 to the "normal standby-mode." FIG. 11A shows the temporal change in the operation mode of the laser printer 1 with the temporal change in the surface temperature T of the fuser roller 22, in graph depicted by a solid line. The above shifting allows for a quick start of printing and adequate fixing in response to issue of a coming print request, while allowing for reduction in power consumption of the laser printer 1.

Figure 11B:
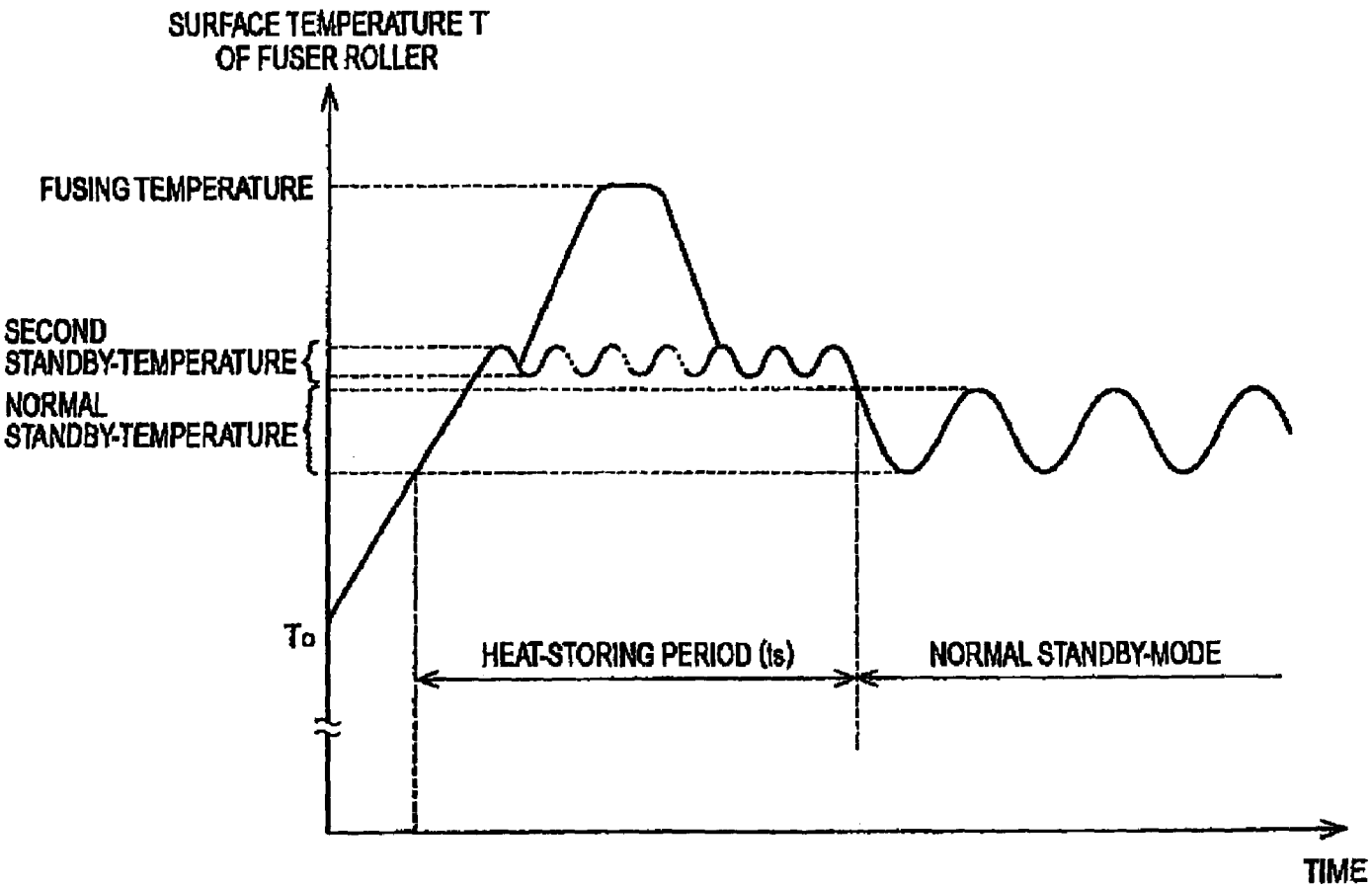
FIG. 11B is a graph showing still another example of temporal changes in surface temperature of the fuser roller of the laser printer shown in FIG. 1.

On the other hand, if the page count of the printed sheets fails to amount to five, then the determination of the step S52 becomes negative "NO," and a step S54 is implemented to make a shifting of the operation mode of the laser printer 1 to the "second standby-mode," provided that the determination of a step S63 is negative "NO" because of the performed printing not being the aforementioned thick paper printing. FIG. 11B shows the temporal change in the operation mode of the laser printer 1 with the temporal change in the surface temperature T of the fuser roller 22, in graph depicted by a solid line. The above shifting allows for a quick start of printing and adequate fixing in response to issue of a coming print request.

Even if the above page count of the printed sheets fails to amount to five, only if the "thick paper printing" was performed, the determination of the step S53 becomes affirmative "YES," the step S51 is implemented to shift the operation mode of the laser printer 1 to the "normal standby-mode." The reason is that, in the case of the "thick paper printing, " the actual temperature of the fuser roller 22 is maintained at a temperature-higher than the fusing temperature Tp required for the normal or standard printing, as described above, and therefore, an event of the heat-storing of the fuser unit 7 is adequately experienced, resulting in a quick start-up of printing and adequate fixing in response to a coming print request.

Once the standby-mode determination routine determines that the operation mode to be achieved is the "normal standby-mode," then the determination of a step S37*a* as shown in FIG. 12 becomes affirmative, "YES," and the computer 40 proceeds to the step S33. On the other hand, once the standby-mode determination routine determines that the operation mode to be achieved is the "second standby-mode," then the determination of the step S37*a* becomes negative "NO," and the computer 40 proceeds to the step S35.

As will be readily understood from the above explanation, in the present embodiment, a portion of the computer 40 which is assigned to the execution of the temperature control program shown in FIG. 6 and to the execution of a portion of the print control program shown in FIG. 12 which relates to the establishment of the operation mode of the laser printer 1 constitutes an example of the "controller" set forth in the above mode (1), and a portion of the computer 40 which is assigned to implement the steps S50 and S51 shown in FIG. 5 and the step Si shown in FIG. 6 constitutes an example of the "first setting device" set forth in the above mode (2).

Further, in the present embodiment, a portion of the computer 40 which is assigned to implement the step S1 shown in FIG. 6 (including the steps S13 and S14 shown in FIG. 7) constitutes an example of the "limit setting device" set forth in the above mode (3), a portion of the computer 40 which is assigned to implement the steps S40 and S41 shown in FIG. 4 constitutes an example of the "first period determining device" set forth in the above mode (5), and a portion of the computer 40 which is assigned to implement the steps S33*a* and S33*b* shown in FIG. 12 constitutes an example of the "first cold-start determining device" set forth in the above mode (8).

Still further, in the present embodiment, a portion of the computer 40 which is assigned to implement the steps S35*a*, S36, S36*b*, and S37 each shown in FIG. 12, and the steps S50 and S51 shown in FIG. 5 constitutes an example of the "second setting device" set forth in the above mode (12), and a portion of the computer 40 which is assigned to implement the step S36*b* shown in FIG. 12 constitutes an example of the "fusing-operation determining device" set forth in the above mode (13).

Yet further, in the present embodiment, a portion of the computer 40 which is assigned to implement the steps S50, S51, and S54 shown in FIG. 5 constitutes an example of the "third setting device" set forth in the above mode (14), a portion of the computer 40 which is assigned to implement the steps S51, S52, and S54 constitutes an example of the "fourth setting device" set forth in the above mode (15), and a portion of the computer 40 which is assigned to a portion of the step S52 shown in FIG. 5 constitutes an example of the "measuring device" set forth in the above mode (16).

Further, in the present embodiment, a portion of the computer 40 which is assigned to the steps S51, S53, and S54 shown in FIG. 5 constitutes an example of the "fifth setting device" set forth in the above mode (17).

Still further, in the present embodiment, the fuser unit 7 constitutes an example of the "fuser unit" set forth in the above mode (1) or (21).

Then, with reference to FIGS. 13 and 14, a laser printer constructed according to a second embodiment of the present invention will be described.

Described in comparison with the first embodiment, the present embodiment is largely common to the first embodiment in the hardware and software construction, while the present embodiment differs from the first embodiment only in the software-implemented elements for establishment of the desired temperature in the "second standby-mode."

In view of the above, the common elements of the present embodiment to those of the first embodiment will be referenced the same names or the same reference numerals as those in the description and illustration of the first embodiment, without a redundant description and illustration, while the different elements of the present embodiment from those of the first embodiment will be described in more detail.

Figure 13:
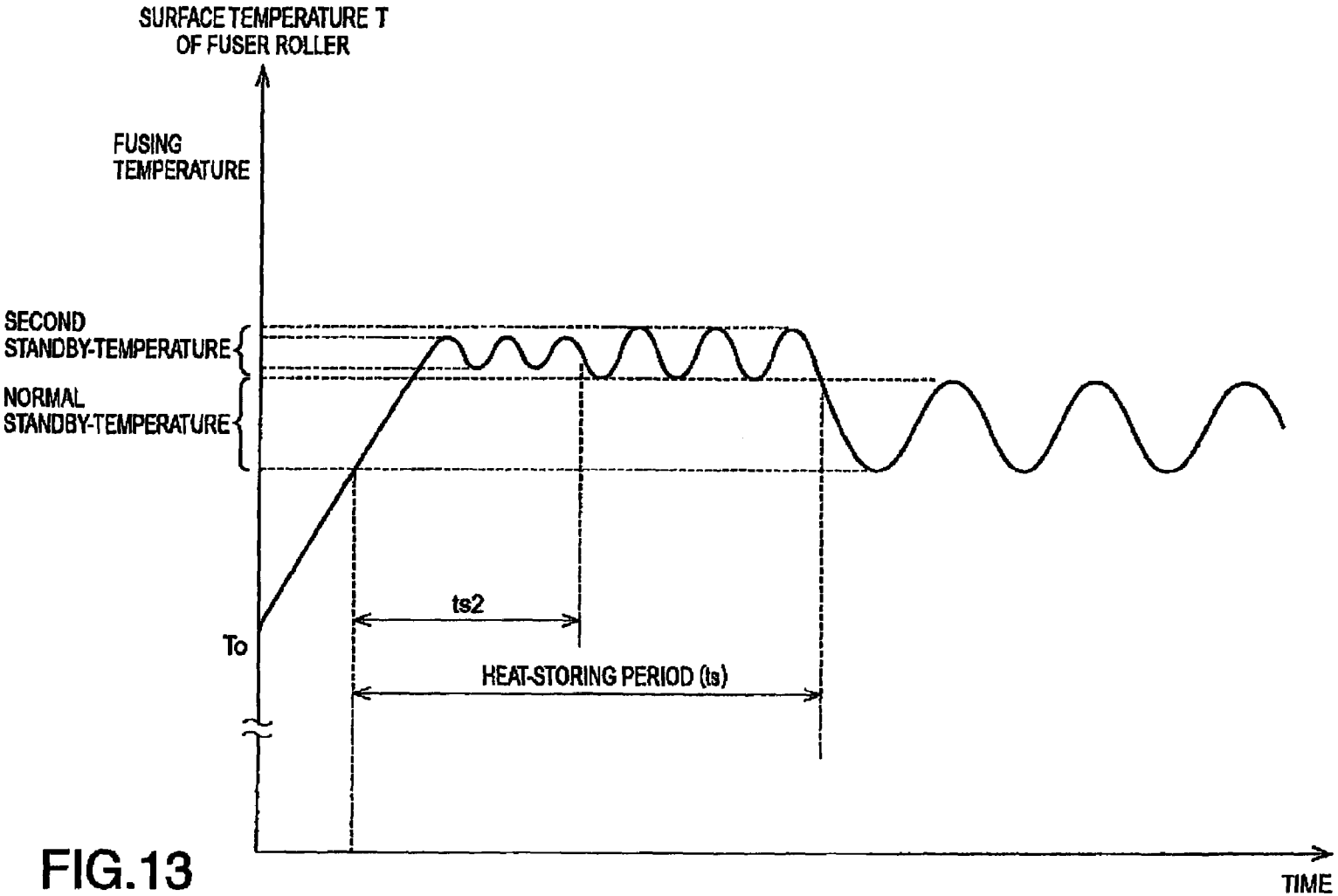
FIG. 13 is a graph showing an example of temporal changes in surface temperature of a fuser roller of a laser printer according to a second embodiment of the present invention.

FIG. 13 illustrates in graph the temporal change in the surface temperature T of the fuser roller 22 in the laser printer constructed according to the present embodiment, wherein the temporal change occurs from a power-on event of the laser printer according to the present embodiment.

In the present embodiment, the dead band for the on-off control of the heater 24 performed in the "second standby-mode" is not constant in width throughout the heat-storing period (the time ts). The dead band means an allowable range of the desired temperature of the fuser roller 22 during the on-off control, i.e., the difference between the upper and the lower limits of the desired temperature.

More specifically, in the present embodiment, the dead band is varied in width between an early part and a later part of the heat-storing period. Still more specifically, the width of the dead band is defined, such that it is small during the early part of the heat-storing period, and is large during the later part of the heat-storing period.

Describing more particularly, first and second sets of limits are provided with the second standby-temperature, each of which includes an upper limit and a lower limit. The difference between the upper and lower limits for the first set is smaller than that of the second set.

Once the second standby-mode begins, the desired temperature of the fuser roller 22 is initially established so as to be defined by the first set, which is smaller in difference than the second set. If the count value of the aforementioned timer for second standby-mode, which is counted down, amounts to a predetermined value corresponding to the length of a time ts2 shorter than the length of the heat-storing period, i.e., the aforementioned time ts, the desired temperature of the fuser roller 22 is re-established so as to be defined by the second set, which is larger in difference than the first set.

In the present embodiment, the step S14 shown in FIG. 7 is modified for establishing the desired temperature of the fuser roller 22 such that the allowable range is varied in width as described above. FIG. 14 shows schematically in flow chart the modified step S14 as a routine for establishment of second standby-mode.

The routine for establishment of second standby-mode is initiated with a step S81 to set the initial count value of a down-count timer to a value corresponding to the length of the aforementioned time ts2. The step S81 is followed by a step S82 to define or delimit the allowable range of the desired temperature of the second standby-temperature, by the use of the upper and lower limits having a smaller difference therebetween, i.e., the first set. The thus defined desired temperature is stored in the RAM 34.

Thereafter, a step S83 is implemented to decrement the count value of the aforementioned down-count timer. The step S83 is followed by a step S84 to determine whether the count value of the down-count timer equals "0." The steps S83 and S84 are repeatedly implemented, until the determination of the step S84 becomes affirmative "YES" because the count value of the down-count timer becomes "0."

If the count value of the down-count timer becomes "0" due to elapse of the aforementioned time ts2 from the start of a second standby-mode, then the determination of the step S84 becomes affirmative "YES." The step S84 is followed by a step S85 to define or delimit the allowable range of the desired temperature of the second standby-temperature, by the use of the upper and lower limits having a larger difference therebetween, i.e., the second set. The thus defined desired temperature is stored in the RAM 34.

Where a print request is issued from the PC 38 during the early part of the projected heat-storing period, during which the allowable range of the desired temperature is small in width, the length of a portion of the projected heat-storing period which the heat storage in the fuser unit 7 was actually experienced, i.e., the actual heat-storing period is short in length. In this case, the heat storage in the fuser unit 7 that was actually experienced is less adequate than where a print request is issued from the PC 38 during the later part of the projected heat-storing period.

However, the allowable range of the desired temperature during the early part is smaller in width, and therefore, though the fuser roller 22 is heated up to the fusing temperature Tp and then initiates an fusing operation, the variations in temperature of the fuser roller 22 are reduced just after the start of the fusing operation.

On the other hand, where a print request is issued from the PC 38 during the later part of the projected heat-storing period, during which the allowable range of the desired temperature is large in width, the actual heat-storing period is long in length. In this case, the fuser unit 7 has been entirely warmed up to a considerable extent. Therefore, though the allowable range is larger in width than that of the early part of the same heat-storing period, the variations in temperature of the fuser roller 22 are reduced just after the start of the fusing operation.

The laser printer according to the present embodiment, despite that the desired temperature of the fuser roller 22 is provided with the allowable range throughout the heat-storing period, permits the allowable range to be increased in width when the heat storage progresses to some degree, to thereby reduce the frequency of the alternate changes between on and off states of the heater 24. The laser printer is therefore advantageous in reducing events of flickers of the room lights, e.g., fluorescents.

Figure 14:
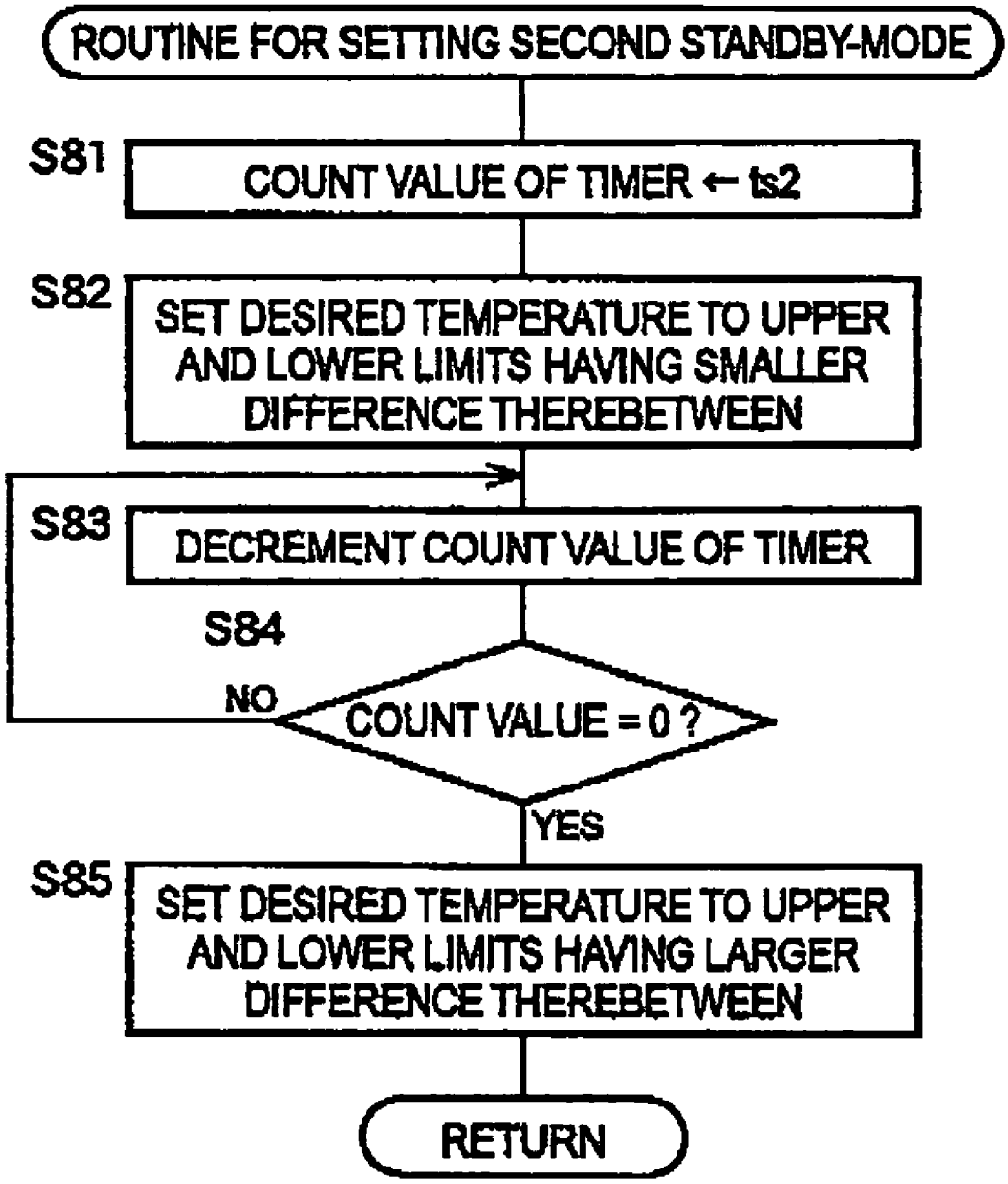
FIG. 14 is a flow chart schematically illustrating a routine for setting a timer for a second standby-mode, executed by a computer of the laser printer according to the second embodiment.

As is evident from the above, in the present embodiment, a portion of the computer 40 which is assigned to execute the routine for establishment of second standby-mode shown in FIG. 14 constitutes an example of the "allowable-range setting device" set forth in the above mode (19).

Then, with reference to FIG. 15, a laser printer constructed according to a second embodiment of the present invention will be described.

Described in comparison with the first embodiment, the present embodiment is largely common to the first embodiment in the hardware and software construction, while the present embodiment differs from the first embodiment only in the software-implemented elements for determination of the length of the duration of the "second standby-mode," i.e., the heat-storing period.

In view of the above, the common elements of the present embodiment to those of the first embodiment will be referenced the same names or the same reference numerals as those in the description and illustration of the first embodiment, without a redundant description and illustration, while the different elements of the present embodiment from those of the first embodiment will be described in more detail.

As described above, in the first and the second embodiment, a determination is made as to whether an event of a cold start of the fuser unit 7 is experienced, based on the length of the warm-up time tw for which the fuser roller 22 is increased in temperature from an initial level at the start of the cold start to the normal standby-temperature, which is an example of the "reference temperature" set forth in the above mode (7). Further, the duration of the "second standby-mode," i.e., the desired length of the heat-storing period ts is determined based on the length of the warm-up time tw.

By contrast, in the laser printer constructed according to the present embodiment, it is determined that an event of a cold start of the fuser unit 7 is experienced, if the laser printer received the newest print request, within a given period of time elapsed from a power-on event of the laser printer, or while the operation mode of the laser printer equals a sleep mode.

Further, in the laser printer constructed according to the present embodiment, the desired length of the heat-storing period ts is determined based on the level of the temperature of the fuser roller 22 that is detected by the thermistor 25 at the time that an event of a cold start is detected, which corresponds to the time that a newest cycle of the heat-storing period starts.

Figure 15:
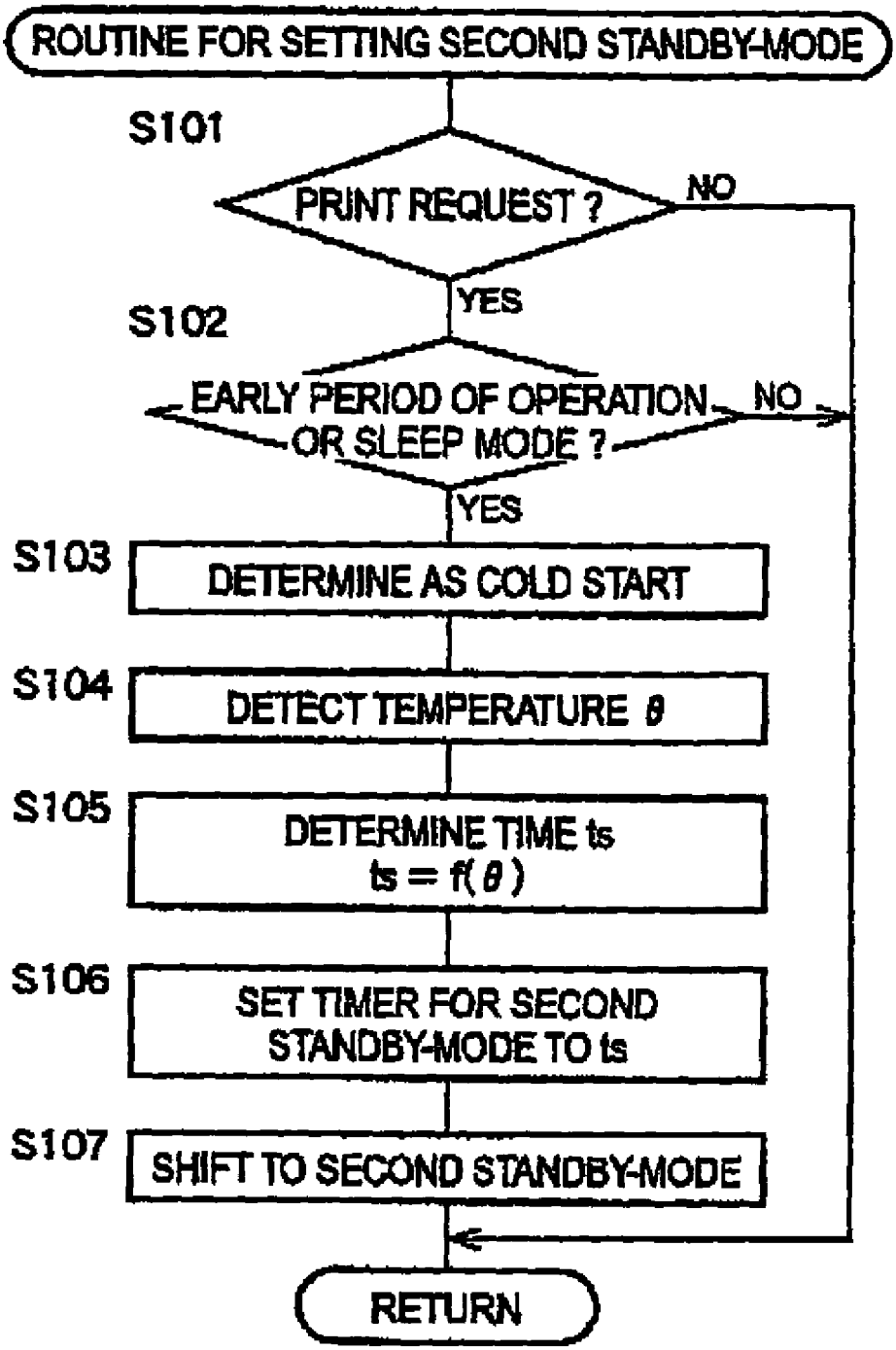
FIG. 15 is a flow chart schematically illustrating a routine for setting a timer for a second standby-mode, executed by a computer of a laser printer according to a third embodiment of the present invention.

FIG. 15 illustrates schematically in flow chart a routine for setting timer for second standby-mode to be executed by the computer 40. The routine for setting timer for second standby-mode is obtained by partially modifying the routine for setting timer for second standby-mode shown in FIG. 4.

The routine for setting timer for second standby-mode, which is shown in FIG. 15, is initiated with a step S101 to determine whether or not the laser printer received a print request. If the laser printer received a print request, the determination of the step S101 becomes affirmative "YES," and a step S102 is implemented to determine whether or not at least one of a first condition that it is within an early period elapsed from a power-on event of the laser printer, and a second condition that the current operation mode of the laser printer equals a sleep mode is met.

If the at least one condition is met, the determination of the step S102 becomes affirmative "YES," and a step S103 is implemented to determine that an event of a cold start is experienced. Subsequently, a step S104 is implemented to detect the temperature θ of the fuser roller 22 by means of the thermistor 25. Thereafter, a step S105 is implemented to determine the desired length of the heat-storing period ts by the use of a predefined function f(θ) of the temperature θ of the fuser roller 22, and detected temperature θ. The function f(θ) has been formulated to represent that the lower the temperature θ becomes, the longer the heat-storing period ts becomes.

The step S105 is followed by a step S106 to set an initial count value of the aforementioned timer for second standby-mode to a given value corresponding to the determined time ts. Subsequently, a step S107 is implemented to shift the operation mode of the laser printer to the "second standby-mode."

As will be readily understood from the above, in the present embodiment, a portion of the computer 40 which is assigned to implement the routine for setting timer for second standby-mode shown in FIG. 15 constitutes an example of the "second period determining device" set forth in the above mode (9), and a portion of the computer 40 which is assigned to implement steps S101 to S103 shown in FIG. 15 constitutes an example of the "second cold-start determining device" set forth in the above mode (11).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An apparatus for forming an image using a fuser unit that heats a receiver medium bearing an unfused toner image thereon, during a relative movement of the receiver medium to the fuser unit, to thereby fuse the unfused toner image onto the receiver medium, the fuser unit comprising:

a fuser roller;

a heater heating the fuser roller;

a temperature sensor detecting a temperature of the fuser roller; and a controller controlling the heater for an actual temperature of the fuser roller to substantially achieve a desired temperature thereof, based on the temperature of the fuser roller detected by the temperature sensor, wherein the controller includes a desired-temperature setting device that selects one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the desired-temperature setting device is operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period, and the desired-temperature setting device comprises a first setting device setting the desired temperature in at least one of a first manner allowing the desired temperature to be initially set to the second standby-temperature during the cold start, and a second manner allowing the desired temperature to be set to any one of the plurality of optional temperatures excluding the second standby-temperature, prior to a setting of the desired temperature to the second standby-temperature.

2. An apparatus for forming an image using a fuser unit that heats a receiver medium bearing an unfused toner image thereon, during a relative movement of the receiver medium to the fuser unit, to thereby fuse the unfused toner image onto the receiver medium, the fuser unit comprising:

a fuser roller;

a heater heating the fuser roller;

a temperature sensor detecting a temperature of the fuser roller; and a controller controlling the heater for an actual temperature of the fuser roller to substantially achieve a desired temperature thereof, based on the temperature of the fuser roller detected by the temperature sensor, wherein the controller includes a desired-temperature setting device that selects one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the desired-temperature setting device is operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period, the desired-temperature setting device comprises a limit setting device establishing an upper limit and a lower limit for each of the second standby-temperature and the normal standby-temperature, and wherein the controller is operated so as to deactivate the heater upon rise of the actual temperature of the fuser roller to the established upper limit, and so as to activate the heater upon drop of the actual temperature of the fuser roller to the established lower limit, and the limit setting device establishes the upper and the lower limit, such that a difference therebetween is smaller for the second standby-temperature during the heat-storing period than for the normal standby-temperature.

3. The apparatus according to claim 2, wherein the heat-storing period is shorter than a period during which the temperature of the fuser roller is maintained at the normal standby-temperature.

4. An apparatus for forming an image using a fuser unit that heats a receiver medium bearing an unfused toner image thereon, during a relative movement of the receiver medium to the fuser unit, to thereby fuse the unfused toner image onto the receiver medium, the fuser unit comprising:

a fuser roller;

a heater heating the fuser roller;

a temperature sensor detecting a temperature of the fuser roller; and a controller controlling the heater for an actual temperature of the fuser roller to substantially achieve a desired temperature thereof, based on the temperature of the fuser roller detected by the temperature sensor, wherein the controller includes a desired-temperature setting device that selects one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the desired-temperature setting device is operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period, and the controller comprises a first period determining device determining a length of the heat-storing period based on at least one of a length of an elapsed time during which the temperature of the fuser roller rises from a temperature thereof at the cold start to a reference temperature, and a gradient of the temperature of the fuser roller, using the temperature of the fuser roller detected by the temperature sensor.

5. The apparatus according to claim 4, wherein the first period determining device determines the length of the heat-storing period such that the longer the length of the elapsed time, the longer the determined length of the heat-storing period.

6. The apparatus according to claim 4, wherein the reference temperature substantially coincides in level with the normal standby-temperature.

7. The apparatus according to claim 4, further comprising a first cold-start determining device determining an event of the cold start.

8. The apparatus according to claim 1, wherein the controller comprises a second period determining device determining a length of the heat-storing period based on the temperature of the fuser roller detected by the temperature sensor at the cold start.

9. The apparatus according to claim 8, wherein the second period determining device determines the length of the heat-storing period such that the lower the temperature of the fuser roller detected by the temperature sensor, the longer the determined length of the heat-storing period.

10. A method of forming an image using a fuser unit that heats a receiver medium bearing an unfused toner image thereon, during a relative movement of the receiver medium to the fuser unit, to thereby fuse the unfused toner image onto the receiver medium, the fuser unit including a fuser roller and a heater heating the fuser roller, the method comprising the steps of:

detecting the temperature of the fuser roller; and controlling the heater for an actual temperature of the fuser roller to substantially achieve a desired temperature thereof, based on the detected temperature of the fuser roller, wherein the step of controlling includes a step of selecting one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the step of selecting is operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period, and the step of selecting comprises a step of selecting one of the second standby-temperature and the normal standby-temperature and setting the desired temperature to the selected one, based on a length of a period during which the temperature of the fuser roller was maintained at the second standby-temperature, upon termination of a fusing operation by the fuser unit during the heat-storing period.

11. The apparatus according to claim 1, wherein the desired-temperature setting device comprises a second setting device setting the desired temperature to the normal standby-temperature, upon termination of a fusing operation by the fuser unit during the heat-storing period.

12. The apparatus according to claim 11, further comprising a fusing-operation determining device determining whether or not a termination of the fusing operation occurs.

13. A method of forming an image using a fuser unit that heats a receiver medium bearing an unfused toner image thereon, during a relative movement of the receiver medium to the fuser unit, to thereby fuse the unfused toner image onto the receiver medium, the fuser unit including a fuser roller and a heater heating the fuser roller, the method comprising the steps of:

detecting the temperature of the fuser roller; and controlling the heater for an actual temperature of the fuser roller to substantially achieve a desired temperature thereof, based on the detected temperature of the fuser roller, wherein the step of controlling includes a step of selecting one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the step of selecting is operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period, and the step of selecting comprises a step of selecting one of the second standby-temperature and the normal standby-temperature and setting the desired temperature to the selected one, wherein when a length of a period during which the temperature of the fuser roller has been maintained at the fusing temperature is longer than the predetermined value, then the normal standby-temperature is selected as the desired temperature of the fuser roller, and otherwise, the second standby-temperature is selected as the desired temperature of the fuser roller.

14. An apparatus for forming an image using a fuser unit that heats a receiver medium bearing an unfused toner image thereon, during a relative movement of the receiver medium to the fuser unit, to thereby fuse the unfused toner image onto the receiver medium, the fuser unit comprising:

a fuser roller;

a heater heating the fuser roller;

a temperature sensor detecting a temperature of the fuser roller; and a controller controlling the heater for an actual temperature of the fuser roller to substantially achieve a desired temperature thereof, based on the temperature of the fuser roller detected by the temperature sensor, wherein the controller includes a desired-temperature setting device that selects one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, and the desired-temperature setting device is operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period, the apparatus further comprising a measuring device measuring whether or not a length of a period during which the temperature of the fuser roller was maintained at the fusing temperature is longer than a predetermined value, based on an amount of the receiver medium processed during a continuous implementation of the fusing operation, wherein the desired-temperature setting device is operated based on a measurement provided by the measuring device, so as to select the normal standby-temperature as the desired temperature of the fuser roller when the length of a period during which the temperature of the fuser roller has been maintained at the fusing temperature is longer that the predetermined value, and so as to select the second standby-temperature as the desired temperature of the fuser roller when the length of the period is not longer than the predetermined value.

15. The apparatus according to claim 1, wherein the desired-temperature setting device comprises a fifth setting device selecting one of the second standby-temperature and the normal standby-temperature and setting the desired temperature to the selected one, based on a kind of the receiver medium for which a fusing operation was implemented by the fuser unit, upon termination of the fusing operation during the heat-storing period.

16. An apparatus for forming an image using a fuser unit that heats a receiver medium bearing an unfused toner image thereon, during a relative movement of the receiver medium to the fuser unit, to thereby fuse the unfused toner image onto the receiver medium, the fuser unit comprising:

a fuser roller;

a heater heating the fuser roller;

a temperature sensor detecting a temperature of the fuser roller; and a controller controlling the heater for an actual temperature of the fuser roller to substantially achieve a desired temperature thereof, based on the temperature of the fuser roller detected by the temperature sensor, wherein the controller includes a desired-temperature setting device that selects one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the desired-temperature setting device is operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period, and the controller comprises an allowable-range setting device setting an allowable range for the second standby-temperature, such that a width of the allowable range is varied with time during the heat-storing period.

17. The apparatus according to claim 16, wherein the allowable-range setting device sets the allowable range such that the width of the allowable range becomes larger during a later part of the heat-storing period than during an early part of the same heat-storing period.

18. An apparatus for forming an image using a fuser unit that heats a receiver medium bearing an unfused toner image thereon, during a relative movement of the receiver medium to the fuser unit, to thereby fuse the unfused toner image onto the receiver medium, the fuser unit comprising:

a fuser roller;

a heater heating the fuser roller;

a temperature sensor detecting a temperature of the fuser roller; and a controller controlling the heater for an actual temperature of the fuser roller to substantially achieve a desired temperature thereof, based on the temperature of the fuser roller detected by the temperature sensor, wherein the controller includes a desired-temperature setting device that selects one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the desired-temperature setting device is operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period, and the desired-temperature setting device is operated during a non-cold start of the fuser unit, so as to select one of the fusing temperature and the normal standby-temperature which excludes the second standby-temperature.

19. A method of forming an image using a fuser unit that heats a receiver medium bearing an unfused toner image thereon, during a relative movement of the receiver medium to the fuser unit, to thereby fuse the unfused toner image onto the receiver medium, the fuser unit including a fuser roller and a heater heating the fuser roller, the method comprising the steps of:

detecting the temperature of the fuser roller; and controlling the heater for an actual temperature of the fuser roller to substantially achieve a desired temperature thereof, based on the detected temperature of the fuser roller, wherein the step of controlling includes a step of selecting one of a plurality of optional temperatures including: a fusing temperature at which the unfused toner image is to be fused to the receiver medium; a normal standby-temperature which is a desired standby-temperature of the fuser roller in a normal standby period, lower than the fusing temperature; and a second standby-temperature which is a second desired standby-temperature of the fuser roller in a second standby period, lower than the fusing temperature and higher than the normal standby-temperature, and that sets the desired temperature of the fuser roller to the selected one, the step of selecting is operated during a cold start of the fuser unit, so as to set the desired temperature of the fuser roller to the second standby-temperature, so as to maintain the desired temperature of the fuser roller at the second standby-temperature during a heat-storing period during which heat is stored in the fuser unit, and so as to set the desired temperature of the fuser unit to the normal standby-temperature upon termination of the heat-storing period, and the step of selecting comprises a step of setting the desired temperature in at least one of a first manner allowing the desired temperature to be initially set to the second standby-temperature during the cold start, and a second manner allowing the desired temperature to be set to any one of the plurality of optional temperatures excluding the second standby-temperature, prior to a setting of the desired temperature to the second standby-temperature.

* * * * *